US006578949B2

(12) United States Patent
Takahashi et al.

(10) Patent No.: US 6,578,949 B2
(45) Date of Patent: Jun. 17, 2003

(54) INK JET RECORDING DEVICE AND METHOD OF DRIVING AND CONTROLLING THE SAME

(75) Inventors: Masaru Takahashi, Nagano (JP); Hitoshi Hayakawa, Nagano (JP); Kojiro Izuka, Nagano (JP); Mitsugu Ota, Nagano (JP); Takashi Akase, Nagano (JP); Hideki Okumura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/950,716

(22) Filed: Sep. 13, 2001

(65) Prior Publication Data

US 2002/0036671 A1 Mar. 28, 2002

(30) Foreign Application Priority Data

Sep. 13, 2000 (JP) ..... 2000-277760
Dec. 28, 2000 (JP) ..... 2000-403295
Jun. 25, 2001 (JP) ..... 2001-190655

(51) Int. Cl.[7] ..... B41J 2/165
(52) U.S. Cl. ..... 347/30; 347/29; 347/23; 347/32; 347/33
(58) Field of Search ..... 347/30, 23, 29, 347/32, 33

(56) References Cited

U.S. PATENT DOCUMENTS 4,371,881 A * 2/1983 Bork et al. ..... 347/29
5,394,178 A * 2/1995 Grange ..... 347/32
5,440,331 A * 8/1995 Grange ..... 347/32
5,608,432 A * 3/1997 Yamaguchi ..... 347/22
5,699,092 A * 12/1997 Kawakami et al. ..... 347/30
5,847,728 A * 12/1998 Lee ..... 347/29
5,870,115 A * 2/1999 Kikuchi et al. ..... 347/24
6,168,257 B1 * 1/2001 Aldrich ..... 347/32
6,286,931 B1 * 9/2001 Kawakami et al. ..... 347/104

FOREIGN PATENT DOCUMENTS

EP 0 604 068 A2 6/1994
EP 0 720 913 A2 7/1996
EP 0 896 881 A2 2/1999
EP 0 845 360 A2 6/1999
JP 10-193629 7/1998 ..... B41J/2/165

* cited by examiner

*Primary Examiner*—John Barlow
*Assistant Examiner*—Leonard Liang
(74) *Attorney, Agent, or Firm*—Sughrue Mion, PLLC

(57) ABSTRACT

A cap member (10) which is brought into contact with a nozzle forming surface of a recording head (15) to seal up the nozzle forming surface, and a wiping member (11) which may be brought into sliding contact with the nozzle forming surface of the recording head (15) are disposed on a cap holder (31). With progress of a cleaning operation in which ink is placed under a negative pressure, and sucked and discharged from the recording head, a cap retaining member (50) is moved upward and placed to a set state, whereby blocking the slanting and downward movement of the cap member (10). Then, the wiping member (11) located on the cap holder (31) slides on the nozzle forming surface to wipe the nozzle forming surface. To a flushing operation, the cap retaining member (50) is moved downward and placed to a reset state. In this state, the wiping member (11) does not slide on the nozzle forming surface.

19 Claims, 16 Drawing Sheets

INK JET RECORDING DEVICE AND METHOD OF DRIVING AND CONTROLLING THE SAME

BACKGROUND OF THE INVENTION

The present invention relates to an ink jet recording device, in which the ink jet recording device includes an ink jet recording head which is mounted on a carriage and ejects ink drops in accordance with print data, and a capping unit which seals and covers a nozzle forming surface of the recording head and receives a negative pressure from a suction pump to suck ink from the recording head and to discharge the ink outside. More particularly, the invention relates to an ink jet recording device in which a wiping member is mounted on the capping unit, and is brought into sliding contact with the nozzle forming surface of the recording head to wipe the nozzle forming surface, and a method for driving and controlling the ink jet recording device.

Generally, the ink jet recording device includes an ink jet recording head which receives ink from an ink cartridge, and a sheet feeding unit for moving a recording sheet of paper relative to the recording head. The recording device records an image pattern on the recording sheet in accordance with print data, while moving the recording head. A recording head, which is able to eject color inks of colors, such as black, yellow, cyan and magenta color inks, is mounted on a carriage. With use such a recording head, the ink jet recording device is capable of performing the full color printing as well as the text printing by varying a ratio of the color inks to be ejected.

To print by the recording head, ink is pressurized in a pressure generating chamber, and ejected through the nozzle opening of the head in the form of ink droplets onto the recording sheet. For this reason, the recording head has a possibility of causing a printing failure due to trouble regarding ink ejecting effect from the nozzle opening, such as an increase of ink viscosity or solidification of ink due to evaporation of solvent contained in the ink from the nozzle openings, the attaching of dust, and the entering of air bubbles into the head.

To cope with this, this type of ink jet recording device includes a capping unit for sealing and covering the nozzle forming surface of the recording head when the device is in a non-print mode. The capping unit functions as a lid for preventing the ink from drying at the nozzle openings of the recording head. When the nozzle opening or openings are clogged, the capping unit also functions to remove the clogging in a manner that it sucks the ink from the nozzle openings by the utilization of a negative pressure from the suction pump.

The forcible ink sucking operation for removing the clogging is called a cleaning operation. The cleaning operation is performed when the recording device have been left not used for a long time and starts again its operation, when the user recognizes a printing failure and operates a cleaning switch, and in other situations. In the cleaning operation, a negative pressure is applied from the suction pump to the nozzle forming surface of the recording head, and the ink is sucked therefrom and discharged into the capping unit. Then, the nozzle forming surface is wiped out with a wiping member made of rubber or the like.

In the related recording device, the capping unit is mounted on a drive unit which is capable of crawling on the nozzle forming surface of the recording head by the utilization of a drive force of the carriage when it moves to the home position. The wiping member is mounted on a horizontal drive unit which moves to and from a movement region of the recording head within which the recording head is moved with the movement of the carriage. With the cleaning operation, a cleaning sequence is executed in which the wiping member wipes out the nozzle forming surface of the recording head while rubbing lightly the surface.

Thus, in the related recording device, separate drive units are used; the vertical drive unit for vertically driving the capping unit and the horizontal drive units for driving the recording head within the movement region in the horizontal direction. This fact entails the increase of device size and cost to manufacture.

Many recording devices of this type are designed such that the power generated by a sheet feeding motor, which feeds a recording sheet in a direction orthogonal to the moving direction of the carriage, is utilized for the drive force necessary for the horizontal drive unit for driving the wiping member for its forward and backward movement, and the drive force necessary for the suction pump.

To this end, a friction clutch is incorporated into the drive unit for driving the wiping member. In an initial stage of the rotation of the sheet feeding motor to one direction, the wiping member is advanced to the head movement region and is put to a set state. In an initial stage of the rotation of the motor to the other direction, the wiping member is retracted from the head movement region and is put to a reset state through the friction clutch.

Accordingly, if, as the result of the cleaning operation, the friction clutch is smeared with waste ink sucked from the recording head and waste ink wiped from the nozzle forming surface of the recording head, the normal driving of the wiping member is hindered. Further, if the gear, e.g., a drive gear, for transmitting a drive force to the friction clutch, is smeared with the waste ink, solidified waste ink will excessively increase the load of the sheet feeding motor. This will create more serious problems.

An ink jet recording device with a head cleaning mechanism is proposed in JP-A-10-193629. This head cleaning mechanism is operable without the drive unit for moving the wiping member to and from the recording head in the horizontal direction. In the mechanism, a slider is located adjacent to the home position of the recording head. The cap member and the wiping member are supported on the slider. When the recording head moves to the home position, the slider is moved toward the nozzle forming surface of the recording head in connection with the head movement, and the nozzle forming surface of the recording head is sealed and capped with the cap member.

When the recording head is moved apart from the home position, the slider is moved in such a direction as to separate the slider from the nozzle openings of the head, and the sealing of the nozzle forming surface with the cap member is removed. During the slider moves apart from the nozzle openings, the slider is locked to halt its movement. With the subsequent movement of the recording head, the nozzle forming surface of the recording head is wiped out with the cap member.

In the disclosed technique, when the recording head is moved from the home position to the head movement region, the slider is locked and halts its movement. Accordingly, the nozzle forming surface of the recording head is inevitably wiped out with the wiping member. Therefore, also when a flushing operation for idle ink ejection is performed by applying a drive signal not related to the printing to the recording head, the nozzle forming surface is wiped with the wiping member.

During the wiping operation, the solidified ink sticking to the wiping member comes in sliding contact with the nozzle forming surface. As a result, there is the possibility that the solidified ink damages the nozzle forming surface, and the nozzle openings are clogged with the solidified ink. Further, there is possibility that the wiping operation destroys the ink meniscus at the nozzle openings after the ink meniscus have been restored to good condition through the flushing operation.

SUMMARY OF THE INVENTION

Accordingly, an object of the present invention is to provide an ink jet recording device and a method for driving and controlling the same, which solve the problem of the damaging of the nozzle forming surface by the wiping operation and the problem of the hindering of the normal ink ejecting operation by the wiping operation in a manner that the wiping operation by the wiping member is appropriately selected in its execution by the utilization of a mechanical arrangement in which the wiping member is also mounted on a holder on which the cap member is mounted In order to solve the aforesaid object, the invention is characterized by having the following arrangement.

(1) An inkjet recording device including an inkjet recording head which is mounted on a carriage being reciprocatively movable from a print region to a home position, ejects ink drops in accordance with print data and includes a nozzle forming surface, the ink jet recording device comprising:

capping means which seals up the nozzle forming surface and is capable of sucking and discharging ink from the recording head under a negative pressure received from a suction pump, the capping means including, a drive unit controlled so as to approach and separate from the nozzle forming surface, a cap holder mounted on the drive unit, a cap member which is disposed on the cap holder and is capable of being brought into contact with the nozzle forming surface with a movement of the drive unit for sealing up the nozzle forming surface, a wiping member which is mounted on the cap holder at a side of the print region and is slidably contactable on the nozzle forming surface, and a cap retaining member which is selectively moved to and from a moving path of the cap holder and is capable of blocking a movement of the cap holder when the cap holder moves.

(2) The ink jet recording device according to (1), wherein an ink receiving recess is provided between the cap member and the wiping member.

(3) The ink jet recording device according to (2), wherein the ink receiving recess is formed integrally with the cap holder holding the cap member and the wiping member.

(4) The ink jet recording device according to any one of (1) to (3), wherein the cap holder moves forward toward the nozzle forming surface in conjunction with a movement of the carriage toward the home position, so that the nozzle forming surface is sealed with the cap member, the cap holder moves backward from the nozzle forming surface in conjunction with the movement of the carriage toward a print region, so that the sealing of said nozzle forming surface by said cap member is removed, the cap holder is retained by the cap retaining member having advanced to the moving path of the cap holder during the backward movement of the cap holder, and the wiping member held by the cap holder is brought into sliding contact with the nozzle forming surface in a state that the cap holder is retained.

(5) The ink jet recording device according to (4), wherein the cap holder receives a drive force of the carriage with the movement of the carriage to the home position and responsively moves in an oblique and upward direction when the carriage is moved forward to the home position, the cap holder receives the drive force of the carriage with the movement of the carriage toward the print region and responsively moves backward in an oblique and downward direction when the carriage is moved toward the print region, and the cap holder is stopped moving in downward direction by the cap retaining member having advanced to the moving path of the cap holder during the cap holder moves backward in the oblique and downward direction.

(6) The ink jet recording device according to (4) or (5), wherein the suction pump performs a sucking operation when the suction pump is rotated in a first direction, and the cap retaining member advances to the moving path of the cap holder in conjunction with the rotation of the suction pump in the first direction.

(7) The ink jet recording device according to (6), wherein the suction pump is a tube pump which generates a negative pressure when a tube of the tube pump, arcuately disposed, is successively compressed with a roller.

(8) A method for driving and controlling an ink jet recording device including an ink jet recording head which is mounted on a carriage being reciprocatively movable from a print region to a home position, ejects ink drops in accordance with print data and includes a nozzle forming surface, a cap member disposed on a cap holder for sealing up the nozzle forming surface when the cap member comes in contact with the nozzle forming surface, and a wiping member disposed on the cap holder at a side of the print region for wiping the nozzle forming surface when the wiping member is brought into sliding contact with nozzle forming surface, the method comprising the steps of:

sucking and discharging ink from the recording head by applying a negative pressure from a suction pump into the cap member in a state that the nozzle forming surface is sealed with the cap member;

removing the sealing of the nozzle forming surface in conjunction with a movement of the carriage toward the print region, and stopping a downward movement of the cap holder by a cap retaining member having advanced to a moving path of the cap holder; and bringing the wiping member into sliding contact with the nozzle forming surface in conjunction with a further movement of the carriage to the print region.

In the ink jet recording device employing the driving and controlling method mentioned above, the cap member made of a soft material and the wiping member for wiping the nozzle forming surface are disposed on the cap holder. Accordingly, by using the cap retaining member which advances to the moving path of the cap holder and selectively comes in contact with the cap holder, the wiping member may be located on the moving path of the recording head. Therefore, with progress of the cleaning operation, the ink left on the recording head is wiped out, and hence the nozzle forming surface of the recording head is cleaned.

The wiping member disposed on the cap holder may be retracted when the carriage is moved to the print region in a state that the cap retaining member is retracted from the moving path of the cap holder. Accordingly, after the cap member is filled with ink by flushing process, the recording head may be moved to the print region without performing the wiping operation.

The mechanical arrangement mentioned above needs the cap retaining member which is selectively brought into contact with the cap holder. A function to block the retraction of the cap holder upon occasion is merely required for the cap retaining member. Accordingly, it is extremely simple in construction, when comparing with the conventional drive unit for the wiping member, which includes the friction clutch and others.

(9) An ink jet recording device having an ink jet recording head which is mounted on a reciprocatively movable carriage and ejects ink drops in accordance with print data and includes a nozzle forming surface, the ink jet recording devise comprising:

a head cleaning mechanism located adjacent to a home position of the recording head for cleaning the recording head, the head cleaning mechanism including, a cap holder being located adjacent to the home position being movable to and from the nozzle forming surface, a cap member supported on the cap holder and being brought into contact with the nozzle forming surface to seal up the nozzle forming surface, a wiping member supported on the cap holder and being slidable on the nozzle forming surface to wipe the nozzle forming surface in conjunction with the movement of the cap holder, an interlocking mechanism for moving the cap holder to and from the nozzle forming surface in conjunction with the movements of the recording head to and from the home position, and causing the capmember to seal up the nozzle forming surface and removing the sealing of said nozzle forming surface, a suction pump for applying a negative pressure to the cap member so that ink is sucked from the recording head and the sucked ink is discharged outside in a state that the nozzle forming surface is sealed with the cap member, and a holding mechanism for holding the cap holder at a position where the wiping member comes in sliding contact with the nozzle forming surface when the recording head is moved apart from the home position after the sucking and discharging of ink by the suction pump, so that the nozzle forming surface is wiped by the wiping member and the holding state of the cap holder is removed after the wiping operation.

Accordingly, in the recording device thus constructed, when the recording head is moved to the home position, the cap holder is moved to approach to the nozzle forming surface of the recording head by the interlocking mechanism. As a result, the nozzle forming surface of the recording head is sealed with the cap member. In this state, a negative pressure is applied from the suction pump to the cap member, so that ink is sucked and discharged from the recording head. At this time, the wiping member is held at a position where the wiping member may be brought into sliding contact with the nozzle forming surface of the recording head by the holding mechanism. When the recording head is moved backward from the home position after the sucking and discharging of the ink by the suction pump are performed, the nozzle forming surface of the recording head is wiped with the wiping member. Further, the nozzle forming surface is not wiped by the wiping member in a state that the surface is in a dry. Accordingly, the invention successfully prevents such an unwanted situation that the nozzle forming surface is wiped in a dry state to possibly be damaged.

(10) The ink jet recording device according to (1) or (9), wherein at least one of the cap member and the wiping member is formed on the cap holder by two-color molding.

(11) The ink jet recording device according to any one of (1), (9) and (10), wherein the cap member and the wiping member are made of the same soft material.

(12) The ink jet recording device according to any one of (9) to (11), further comprising a restriction mechanism for restricting a displacement of the cap holder apart from the nozzle forming surface when the nozzle forming surface is being wiped by the wiping member.

According to this, a reliable cleaning of the nozzle forming surface is secured.

(13) The ink jet recording device according to any one of (9) to (12), wherein the interlocking mechanism is provided corresponding to the home position of the carriage, and includes a driven member moved by the carriage and converting means for converting the movement of the driven member into the approaching and separating movements of the cap holder.

According to this, the capping of the nozzle forming surface is easily carried out by use of the driven member and the converting means simple in construction, including cams and others. This contributes to construction simplification.

(14) The ink jet recording device according to (13), wherein the holding mechanism is provided between the driven member and a device frame, and includes locking means for locking the driven member at the approaching position of the cap holder, and removing means for removing the locking state of said driven member with the movement of said carriage.

According to this, where the locking means including an interlacing mechanism is provided, the cleaning and wiping of the nozzle forming surface are reliably carried out with a simple construction.

(15) A method for driving and controlling an ink jet recording device according to any one of claims 9 to 14, wherein when the recording head is moved to the home position, the cap member is brought into contact with the nozzle forming surface so that the nozzle forming surface is capped with the cap member, in this state, the operation of sucking ink is performed, thereafter, when the recording head is moved apart from the home position, the nozzle forming surface is brought into sliding contact with said wiping member so that a wiping operation is performed, and a flushing operation of idle ejecting ink drops from the recording head is performed in a state that the recording head is moved to a position just before the home position and the cap member is confronted with the nozzle forming surface without contact, thereafter, the recording head is moved apart from the position just before the home position, without sliding contact between the wiping member and the nozzle forming surface.

Where the driving and controlling method thus arranged is used, when the recording head is moved backward from the position just before the home position after the flushing in which the recording head performs an idle ejection of ink drops, the wiping operation is not performed in which the wiping member slides on the nozzle forming surface. Accordingly, the invention successfully prevents such an unwanted situation that the nozzle forming surface is wiped in a dry state following the flushing mode, thereby to possibly be damaged.

DESCRIPTION OF THE PREFERRED EMBODIMENTS

First Embodiment

Figure 1:
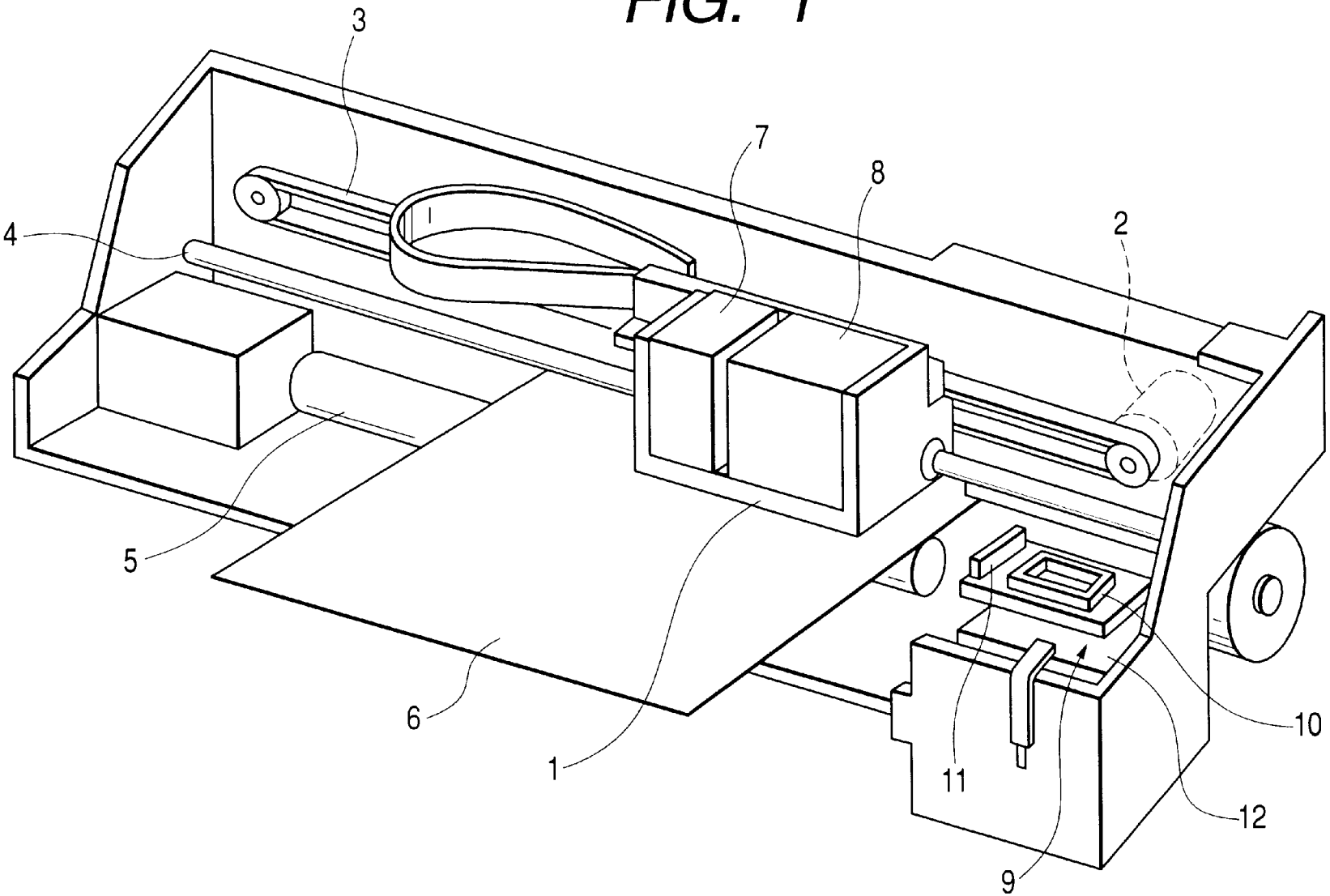
FIG. 1 is a perspective view showing a basic construction of an ink jet recording device incorporating the present invention.

An ink jet recording device constructed according to the present invention will be described by using illustrated preferred embodiments. FIG. 1 is a perspective view showing a basic construction of an ink jet recording device incorporating the present invention. In FIG. 1, reference numeral 1 designates a carriage. The carriage us guided by a guide member 4 and is reciprocated along the shaft of a platen 5 by a timing belt 3 driven by a carriage motor 2.

A recording head (not shown in FIG. 1) (described later) is mounted on a surface (lower surface) of the carriage 1, which faces a recording sheet 6 of paper. A black ink cartridge 7 and a color ink cartridge 8, which supply inks to the recording head, are detachably mounted on the upper side of the carriage.

Reference numeral 9 is a capping unit disposed in a non-print region (home position). A cap member 10 made of a soft material is located in the capping unit 9 and operates such that when the recording head mounted on the carriage 1 moves to a position just above the cap member, the cap member is lifted and seals up the nozzle forming surface of the recording head. A strip like wiping member 11 is mounted on the capping unit 9 and is located at a side of a print region adjacent to the cap member 10. A tube pump 12 as a suction pump (to be described later) for applying a negative pressure to an inner space of the cap member 10 is located under the capping unit 9.

The cap member 10 forming the capping unit 9 functions as a lid for preventing the ink from drying at the nozzle openings of the recording head during a pause period of the recording device. The cap member also functions as a cleaning operation executing mechanism which applies a negative pressure to the nozzle openings and sucks the ink therefrom.

Figure 2:
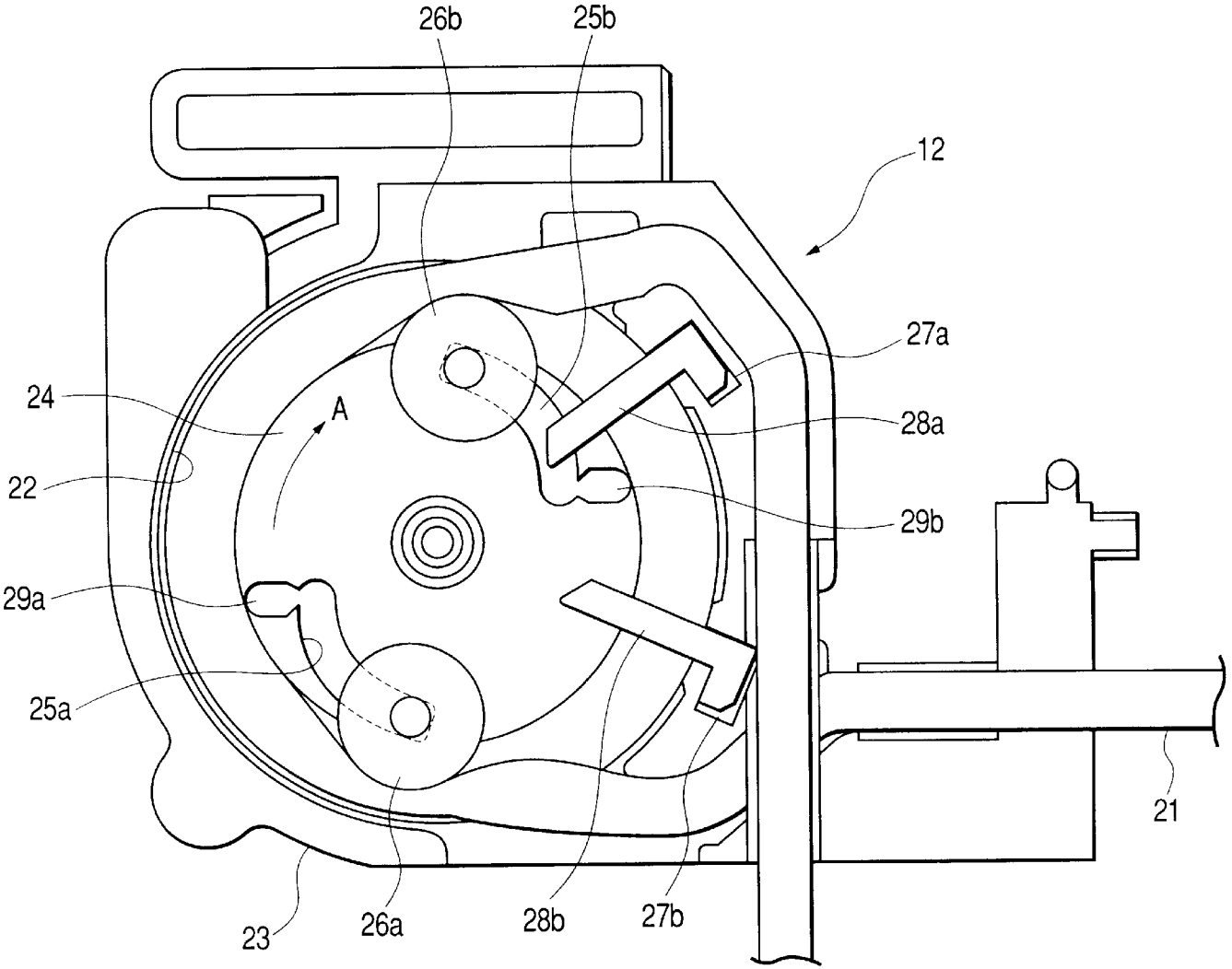
FIG. 2 is a perspective view showing a driving state of a tube pump mounted on the FIG. 1 recording device.
Figure 3:
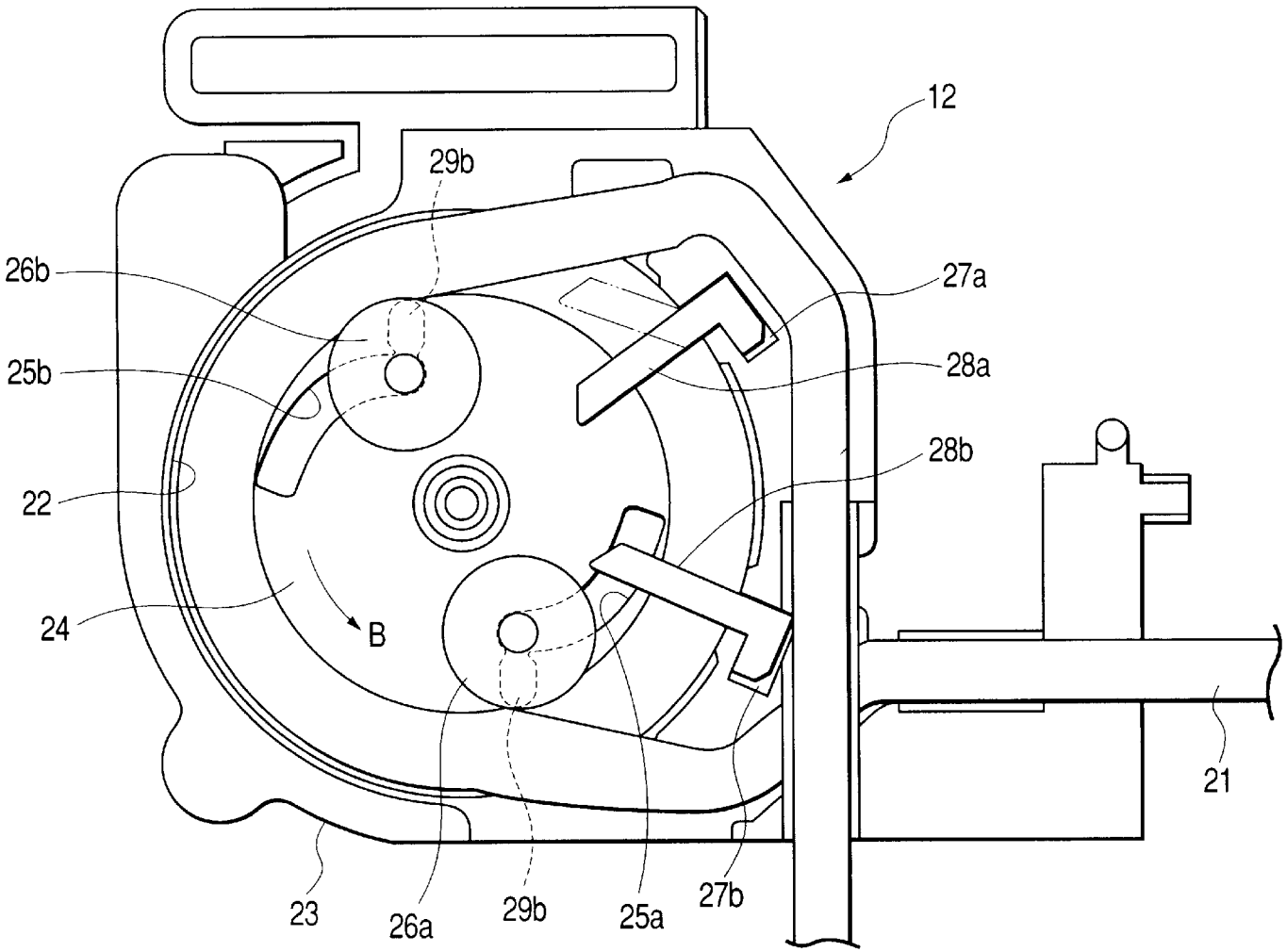
FIG. 3 is a perspective view showing a release state of the tube pump mounted.

FIGS. 2 and 3 are perspective views showing an example of the tube pump for applying a negative pressure to the inner space of the cap member 10 of the capping unit 9. FIG. 2 shows an operation state of the tube pump by rotating in the forward direction. FIG. 3 shows are lease state of the tube pump rotating in the reverse direction. In the cap member 10, a pump wheel 24, which receives a force from a sheet feeding motor and is rotated by the force received, is located on a pump frame 23 having a tube support surface 22 for supporting a flexible tube 21 in an arcuate form.

A pair of roller support grooves 25*a* and 25*b* are formed in the pump wheel 24, are slanted in the radial direction, and are located between an axial direction and a peripheral direction of the pump wheel 24. Rollers 26*a* and 26*b* are provided such that those rollers are rotatable, and movable along the roller support grooves 25*a* and 25*b*, respectively.

L-shaped engaging grooves 27*a* and 27*b* are formed in the pump frame 23 at positions opposite to the tube support surface 22 of the pump frame 23. Guide members 28*a* and 28*b* made of elastic material are fit in the engaging grooves 27*a* and 27*b*, respectively. The tips of the guide members 28*a* and 28*b* are protruded in the axial direction of the pump wheel 24.

In the tube pump thus constructed, as shown in FIG. 2, when the pump wheel 24 is rotated in the forward direction (of an arrow A), the guide members 28*a* and 28*b* guide the rollers 26*a* and 26*b* supported by the roller support grooves 25*a* and 25*b* along those grooves and in the reverse direction. Specifically, with the rotation of the pump wheel to the arrow A direction, the rollers 26*a* and 26*b* are forced back by the guide members 28*a* and 28*b*, and is moved in the outer peripheral direction of the roller support grooves and gradually compresses the flexible tube 21.

As a result, a negative pressure is generated in the flexible tube 21, and transmitted to the inside of the capmember 10 of the capping unit 9. The negative pressure causes the recording head to discharge the ink, and it sucks the ink that is discharged into the cap member 10 and sends the ink to a waste tank (not shown).

On the other hand, when the pump wheel 24 is rotated in the reverse direction (of an arrow B) as shown in FIG. 3, the rollers 43*a* and 43*b* are forced back by the guide members 28*a* and 28*b*. As a result, the rollers move to the inner peripheral side of the roller support grooves. The rollers maintain their release state in which the rollers are in slight contact with the tube. This feature prevents such trouble as the clinging of the tube from occurring. In FIGS. 2 and 3, reference numerals 29*a* and 29*b* indicate roller shaft insertion openings. In assembling the tube pump, the roller shafts are inserted into those roller shaft insertion openings 29*a* and 29*b,* and moved to the roller support grooves 25*a* and 25*b.*

Figure 4:
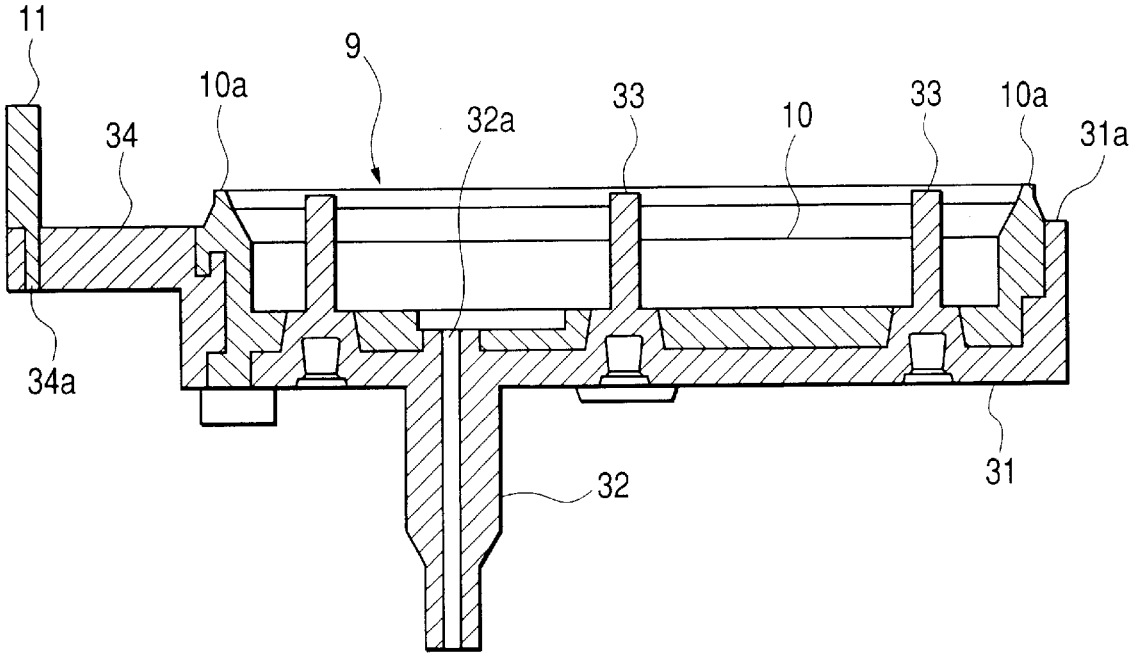
FIG. 4 is a cross sectional view showing one form of a capping means employed by the recording device of the first embodiment.

FIG. 4 is a cross sectional view showing a first example of the capping unit 9 which may be preferably used by the recording device of the first embodiment. In the capping unit 9, the cap member 10 is formed within a cap holder 31 forming an outer shell and is formed by, for example, two-color molding. The cap member 10 is made of soft material, e.g., elastomer, and seals and covers the nozzle forming surface of the recording head as will be described later.

As mentioned above, the upper end of the cap member 10 made of such a material as elastomer is protruded from the opening end face 31*a* of the cap holder 31. The protruded part of the cap member 10 is triangular in cross section. The end face of the top end of the cap member 10 forms a sealing part 10*a,* which comes in contact with the nozzle forming surface of the recording head. With such a structure, a degree of its contact state with the nozzle forming surface of the recording head is increased. Accordingly, the hermetic state of the inner space of the capping unit is kept in good condition.

An ink discharging port 32*a* is formed in the inner bottom of the cap member 10. A connecting pipe 32 is formed integral with the cap holder 31 and communicatively coupled to the ink discharging port 32*a.* One end (suction end) of the flexible tube 21 of the tube pump 12 is adapted to be connected to the connecting pipe 32. A plurality of pins 33 is erected on the inner bottom of the cap holder 31. The tips of the pins 33 are thermally caulked and deformed to support a sheet-like porous member (not shown) place on the inner bottom of the cap member 10.

An extended portion 34 is extended in horizontal direction from the cap holder 31, and a support hole 34*a* is formed in the extended portion 34 and passes therethrough in vertical direction. The wiping member 11 is mounted in an upright state by the utilization of the support hole 34*a.* The wiping member 11 is shaped like a strip and has a width wide enough to cover the nozzle forming surface of the recording head in the widthwise direction.

It is preferable to form the wiping member 11, together with the cap member 10 when the cap member is formed on the cap holder 31 by the two-color molding. The wiping member 11 is made of elastomer, which is the same material of the cap member 10. The capping unit 9 shown in FIG. 4, as will be described later, is mounted on the slider so that the wiping member 11 is located in the side of the print region.

Figure 5:
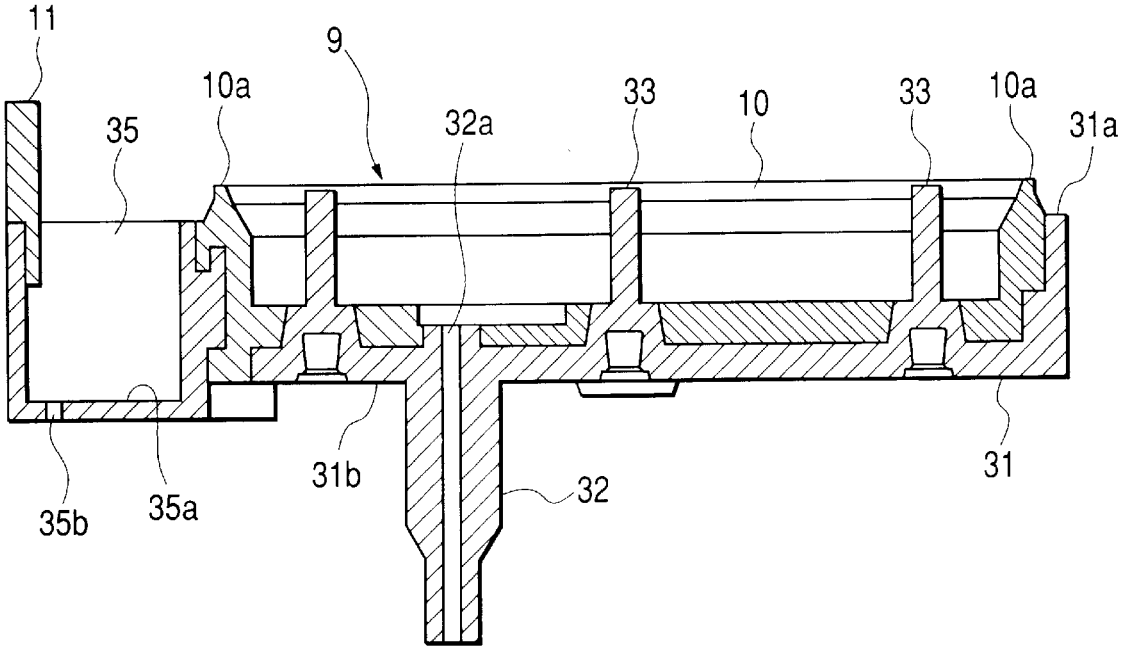
FIG. 5 is a cross sectional view showing another form of the capping means.

FIG. 5 is a cross sectional view showing a second example of the capping unit 9 which may be preferably used by the recording device of the first embodiment. In the capping unit shown in FIG. 5, an ink receiving recess 35 is provided between the cap member 10 and the wiping member 11. The remaining portion of the capping unit is substantially the same as of that in the first example. The ink receiving recess 35 is formed integral with the cap holder 31 which supports the cap member 10 and the wiping member 11.

The inner part of the ink receiving recess 35 is rectangular parallelepiped in shape. The width of the ink receiving recess 35 in the direction perpendicular to the surface of the drawing paper in FIG. 5 is somewhat larger than the corresponding one of the cap member 10. A discharging hole 35*b* is formed at a part of the bottom 35*a* of the ink receiving recess 35 and passes therethrough. The back side surface of the bottom 35*a* is located below the bottom surface 31*b* of the cap holder 31 as viewed in the gravity direction. In other words, the back side of the bottom 35*a* is protruded blow the bottom surface 31*b* of the cap holder 31. The capping unit 9 shown in FIG. 5 is mounted on the slider so that the wiping member 11 is positioned in side of the print region.

In the example shown in the FIG. 5, waste ink wiped from the nozzle forming surface of the recording head by the wiping member 11 is received in the ink receiving recess 35. Further, when the cap holder 31 somewhat inclines downward to the print region, the ink receiving recess 35 receives the waste ink which overflows from the capmember 10. This will be described later. The waste ink received in the ink receiving recess 35 is discharged through the discharging hole 35*b.* Therefore, the smear by the waste ink may be prevented by disposing a waste liquid absorbing member just under the discharging hole 35*b.*

Figure 6:
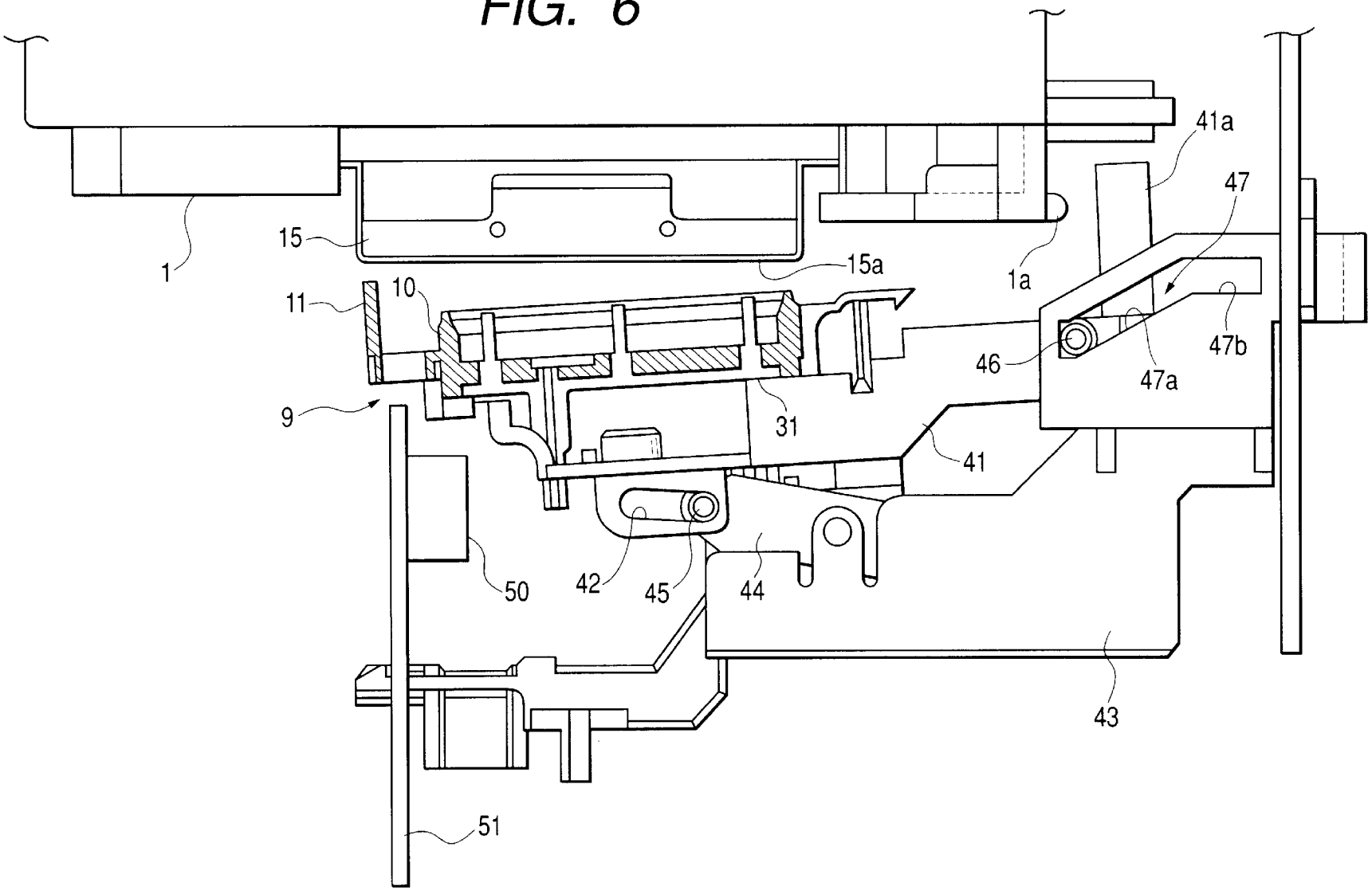
FIG. 6 is a side view showing, partly in cross section, a drive unit in the recording device of the first embodiment when it is in a non-capping mode.
Figure 7:
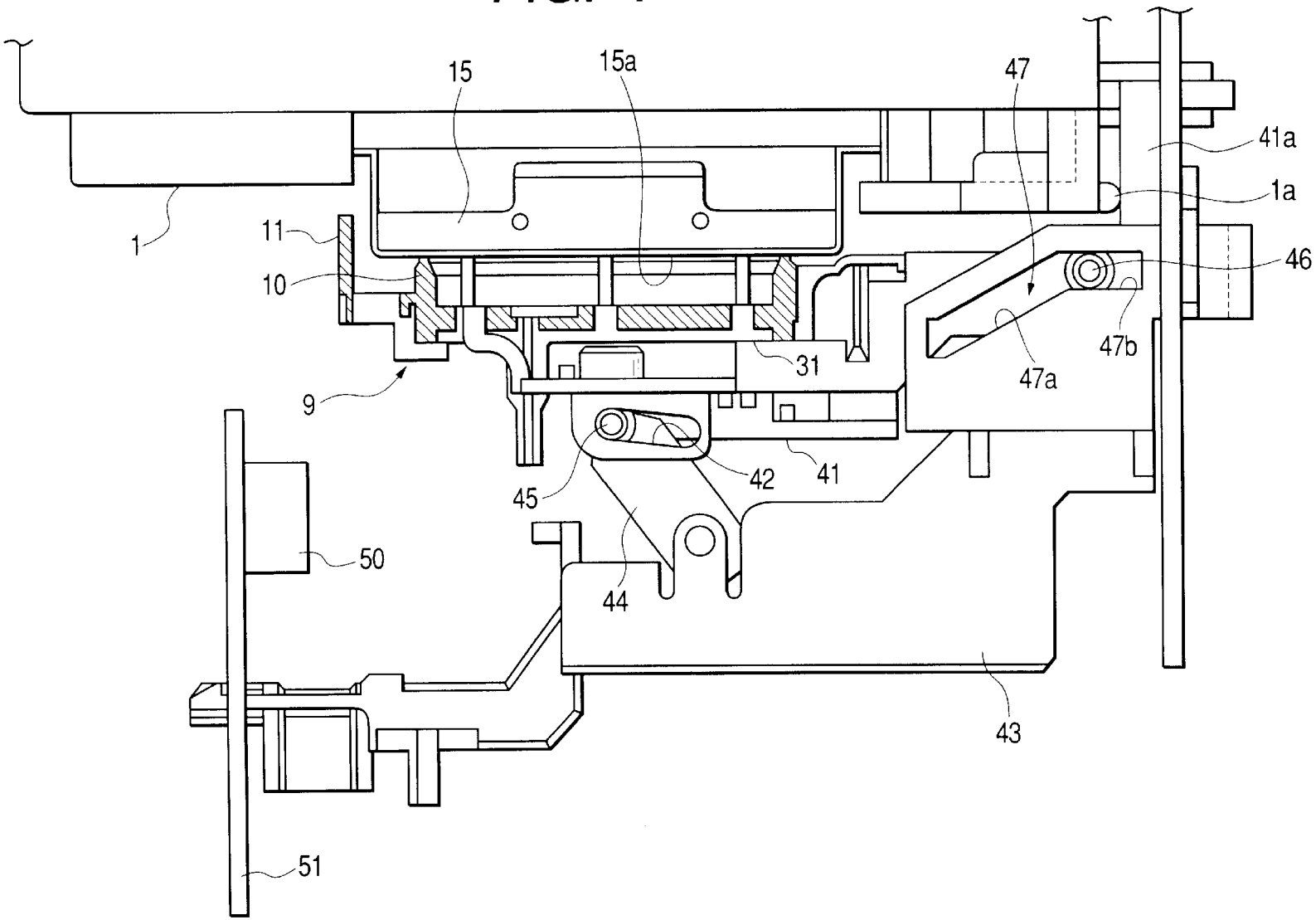
FIG. 7 is a side view showing, partly in cross section, the drive unit when it is in a capping mode.
Figure 8:
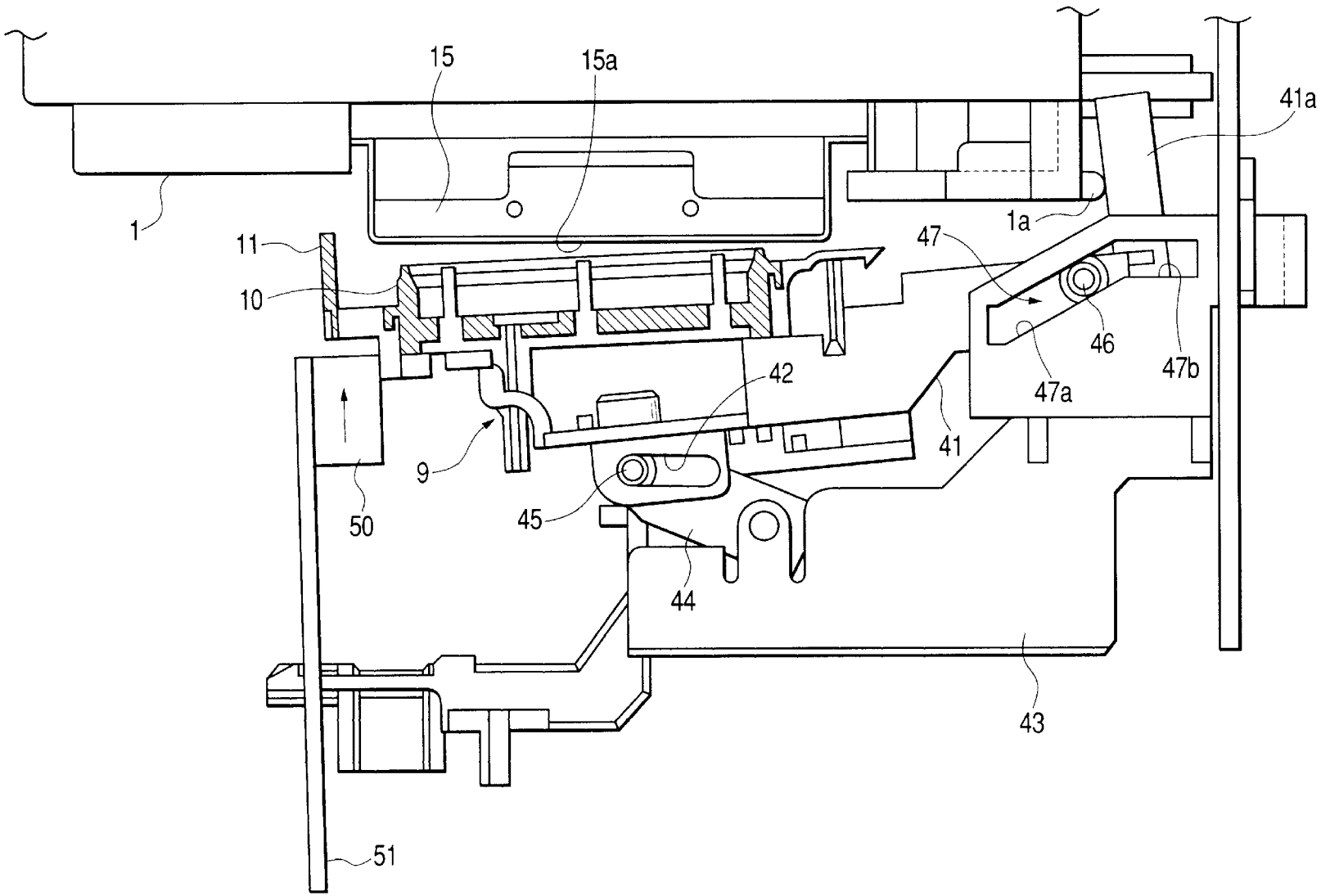
FIG. 8 shows the drive unit when its operation mode shifts from the capping mode to a wiping mode.
Figure 9:
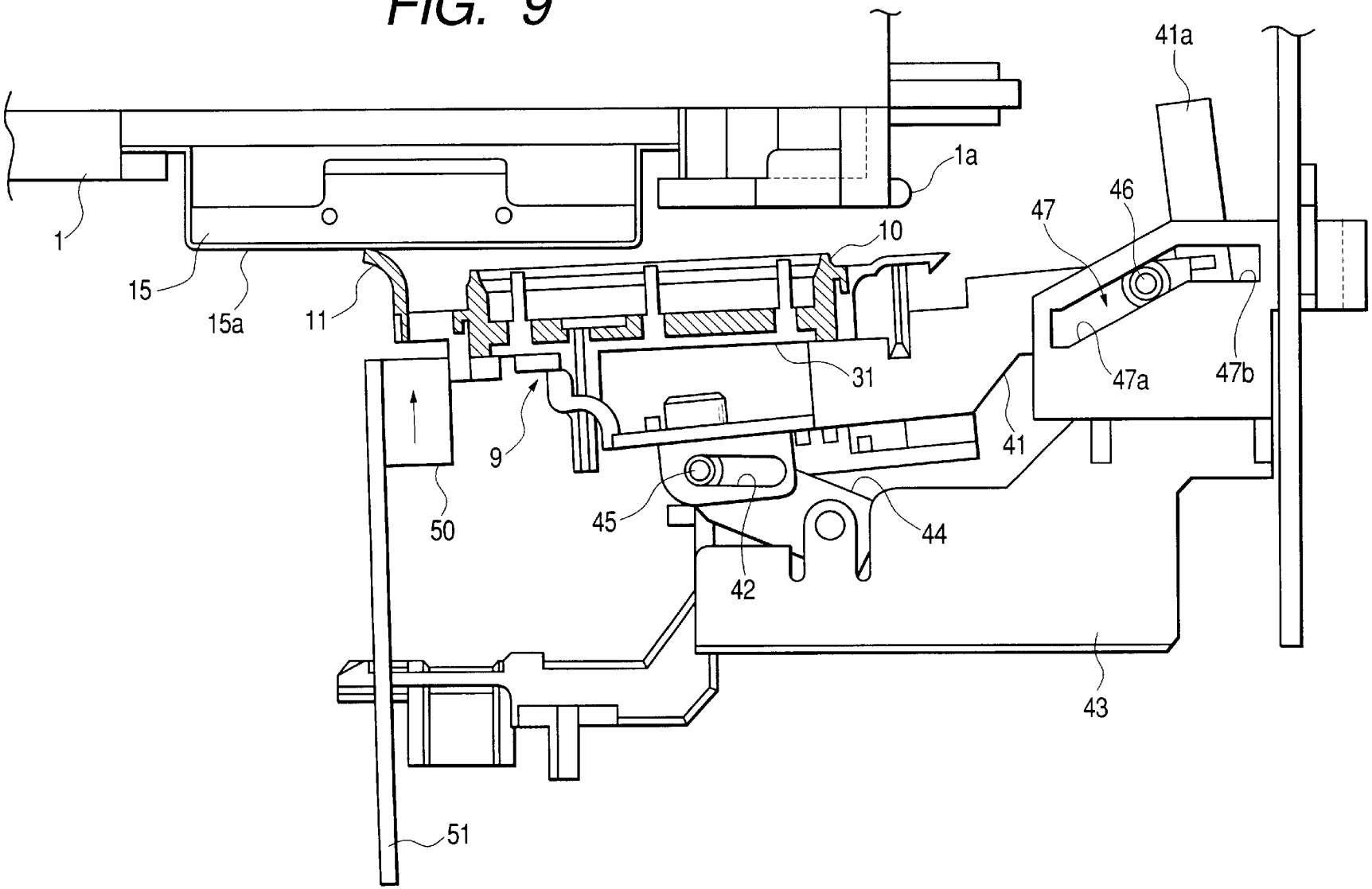
FIG. 9 shows the drive unit which is being operated in the wiping mode.

FIGS. 6 to 9 show a construction of a drive unit for moving upward and downward the capping means 9 mounted thereon with the movement of the carriage. FIG. 6 shows the drive unit in a non-capping mode, and FIG. 7 shows the drive unit in a capping mode. FIG. 8 shows the drive unit when its capping mode is removed and its operation mode shifts to a wiping mode. FIG. 9 shows the drive unit which is being operated in the wiping mode. The drive unit illustrated in FIGS. 6 to 9 employs the capping unit shown in FIG. 4.

In FIGS. 6 to 9, reference numeral 15 designates a recording head mounted on the underside of the carriage 1. With the movement of the carriage 1, the recording head 15 moves to the right and left. The cap holder 31 is mounted on a slider 41 in a state that it is urged to the recording head 15 by a compression spring interposed between the slider 41 and the cap holder 31.

A pair of elongated holes 42 is horizontally extended and is formed in the bottom of the slider 41. A horizontal shaft 45 is slidably put in those elongated holes 42 and is provided at the free ends of an arm 44. The arm 44 is rotatably mounted on a frame 43. The horizontal shaft 45 and the slider 41 are stored so as to be movable. With this structure, the slider 41 is raised with respect to the frame 43 with the aid of the arms 44 and traces an arcuate path.

Guide pieces 46 are formed at and protruded from opposite sides of the end of the slider 41 at non-print region side (right side in the figure), respectively. The guide pieces 46 are supported by a pair of guide grooves 47 of the frame 43, respectively. Each guide groove 47 includes a slanted part 47*a* and a horizontal higher part 47*b* continuous to the slanted part.

Although not illustrated, a tension spring (not shown) is fixed at one end to the slider 41 and at the other end to the frame 43. The slider 41 is pulled to the print region (to the left in the figure), through the action of the tension spring. Specifically, the slider 41 is urged in a direction in which the slider moves apart from the nozzle forming surface of the recording head 15, viz., it is pulled obliquely downward in the embodiment.

When the carriage 1 moves toward the right end in the figure, an engaging piece 1*a* of the carriage 1 comes in contact with an engaged part 41*a* erected from the slider 41. The slider 41 rises with the aid of the arms 44 against the tension of the tension spring. The guide pieces 46 formed in the slider 41 move upward along the slanted part 47*a* of the guide grooves 47 of the frame 43, and reaches the horizontal higher part 47*b.* Through the reciprocal operation, the cap member 10 of the cap holder 31 seals up the nozzle forming surface l5*a* of the recording head 15 mounted on the carriage 1.

When the carriage 1 is moved to the print region, the engaging piece 1*a* of the carriage 1 is disengaged from the engaged part 41*a* of the slider 41. The slider 41 is moved under the tension of the tension spring. As a result, the drive unit returns to the operation mode shown in FIG. 6, and the sealing of the nozzle forming surface of the recording head 15 is removed.

As shown in FIG. 6, the sealing surface of the cap member 10, viz., the upper end face to be brought into contact with the nozzle forming surface of the recording head 15, is not parallel to the nozzle forming surface of the recording head 15. The sealing surface of the cap member 10 is somewhat slanted downward to the print region with respect to the home position side. This sealing surface slanting is achieved by properly selecting the position of the horizontal shaft 45, which is put in the elongated holes 42 of the slider 41, and the position of the guide pieces 46, which are slidably put in the guide grooves 47 of the frame 43.

In a state that the cap member 10 seals up nozzle forming surface of the recording head 15, firstly the cap member 10 starts to contact with the nozzle forming surface from the home position, and then completely seals up the nozzle forming surface 15*a* of the recording head 15 through the compressing action of the compression spring. To remove the sealing of the nozzle forming surface of the recording head 15, the cap member 10 first moves apart from the end of the nozzle forming surface of the recording head 15, which is closer to the print region, and separates from the same and takes an attitude not parallel to the nozzle forming surface while being greatly distanced from the print region.

Thus, to remove the sealing of the nozzle forming surface of the recording head, the cap member 10 moves apart from the end of the nozzle forming surface of the recording head 15, which is closer to the print region, and separates from the nozzle forming surface in a state that it is not in parallel with the nozzle forming surface. The waste ink which will stay on the nozzle forming surface of the recording head is pulled toward the waste ink stored in the cap member 10. Accordingly, the amount of the ink left on the nozzle forming surface of the recording head is minimized. The operation to cancel the sealing state that the cap member 10 seals the nozzle forming surface of the recording head 15 starts from one end of the nozzle forming surface and progresses. Accordingly, the unwanted phenomenon that the waste ink stored in the cap member 10 is bubbled is also suppressed.

A cap retaining member 50 is located on the print-region side of the capping unit. The cap retaining member retains the capping unit during the returning movement of the capping unit. In the present invention, the cap hold member 50 is slidable vertically with respect to a frame base 51. In the states of FIGS. 6 and 7, the cap retaining member 50 is moved downward and at a lower position. In the states of FIGS. 8 and 9, the cap retaining member 50 is moved upward and brought into contact with the cap holder 31 during the returning movement of the capping unit 9, thereby stopping the capping unit 9 going to its original position.

The cap retaining member 50 moves upward on the frame base 51 in a state that the tube pump 12 is being rotated in one direction and performs a suction operation (as above mentioned with referring FIGS. 2 and 3). A mechanism that operates depending on rotational directions of the tube pump 12 or an electromagnetic plunger may be utilized to achieve the vertical movement of the cap retaining member 50.

In the drive unit thus constructed, when the carriage 1 is driven by the carriage motor 2 and moves to the home position, the engaging piece la of the carriage 1 approaches to the engaged part 41*a* of the slider 41 and comes in contact with the same as shown in FIG. 6. The carriage 1 further moves to the home position, and then the slider 41 rises with the aid of the arms 44 as shown in FIG. 7. The guide pieces 46 of the slider 41 slides within the guide grooves 47 and reaches the horizontal higher part 47*b*. On the other hand, the cap member 10 formed integrally with the cap holder 31 seals up the recording head 15 of the recording head 15 mounted on the carriage 1.

When the sealing of the nozzle forming surface with the cap member 10 completes, the cap member 10 is disconnected from the atmosphere to be put in a hermetic state. In this state, evaporation of ink solvent from the nozzle openings, and clogging of the recording head hardly is prevented. In this state, the tube pump 12 is driven and the cleaning operation is performed to suck ink from the nozzle openings of the recording head and to discharge the sucked one.

When the carriage 1 is driven by the carriage motor 2 and moves to the print region, the engaging piece 1*a* of the carriage 1 disengages from the engaged part 46*a* of the slider 41. Accordingly, the slider 41 descends with the aid of the arms 44 of the slider 41 under the tension of the returning spring, and the guide pieces 46 of the slider 41 descends within the guide grooves 47. As a result, the sealing of the recording head 15 by the cap member 10 is removed, as shown in FIG. 6.

When the cleaning operation is executed in the capping mode of the drive unit shown in FIG. 7, the ink is sucked from the recording head 15 under a negative pressure generated when the tube pump 12 is driven, and discharged into and stored in the capping unit 9. At this time, with the suction operation, the cap retaining member 50 is moved upward and set at a higher position as shown in FIG. 8. When the carriage 1 is driven by the carriage motor 2 and moved toward the print region, the capping unit 9 also moves downward in the backward direction and the cap retaining member 50 comes in contact with the cap holder 31 forming the capping unit 9, as shown in FIG. 8.

In this way, the downward and backward movement of the capping unit 9 is blocked. The carriage 1 further moves to the print region and then the wiping member 11 of the cap holder 31 comes in sliding contact with the nozzle forming surface 15*a* of the recording head 15 as shown in FIG. 9. The ink is wiped out of the nozzle forming surface by the cleaning operation. Accordingly, there is no chance that the ink drops from the recording head being in the print region.

As already stated, in this type of the recording device, the flushing operation is repeated at an interval of a predetermined time during the printing operation. In the flushing operation, the carriage 1 is driven by the carriage motor 2 and moves to the home position. With this, the nozzle forming surface 15*a* of the recording head mounted on the carriage 1 is confronted with the cap member 10 with a slight gap therebetween. In this state, a drive signal not related to the printing is applied to the recording head, and the flushing operation is executed from the recording head to the inside of the cap member 10.

When the flushing operation is performed, the cap retaining member 50 has been in a reset state as shown in FIG. 6 or 7. Accordingly, when the carriage 1 is moved to the print region after the flushing operation, the cap holder 31 moves downward and backward while not blocked by the cap retaining member 50. Accordingly, the wiping member 11 mounted on the cap holder 31 also descends, and the recording head is permitted to move to the print region while not being in sliding contact with the wiping member 11. As a result, the recording head may start the printing operation without giving rise to such a situation that the wiping operation destroys the ink meniscus at the nozzle openings after those have been restored to good condition through the flushing operation.

Figure 10:
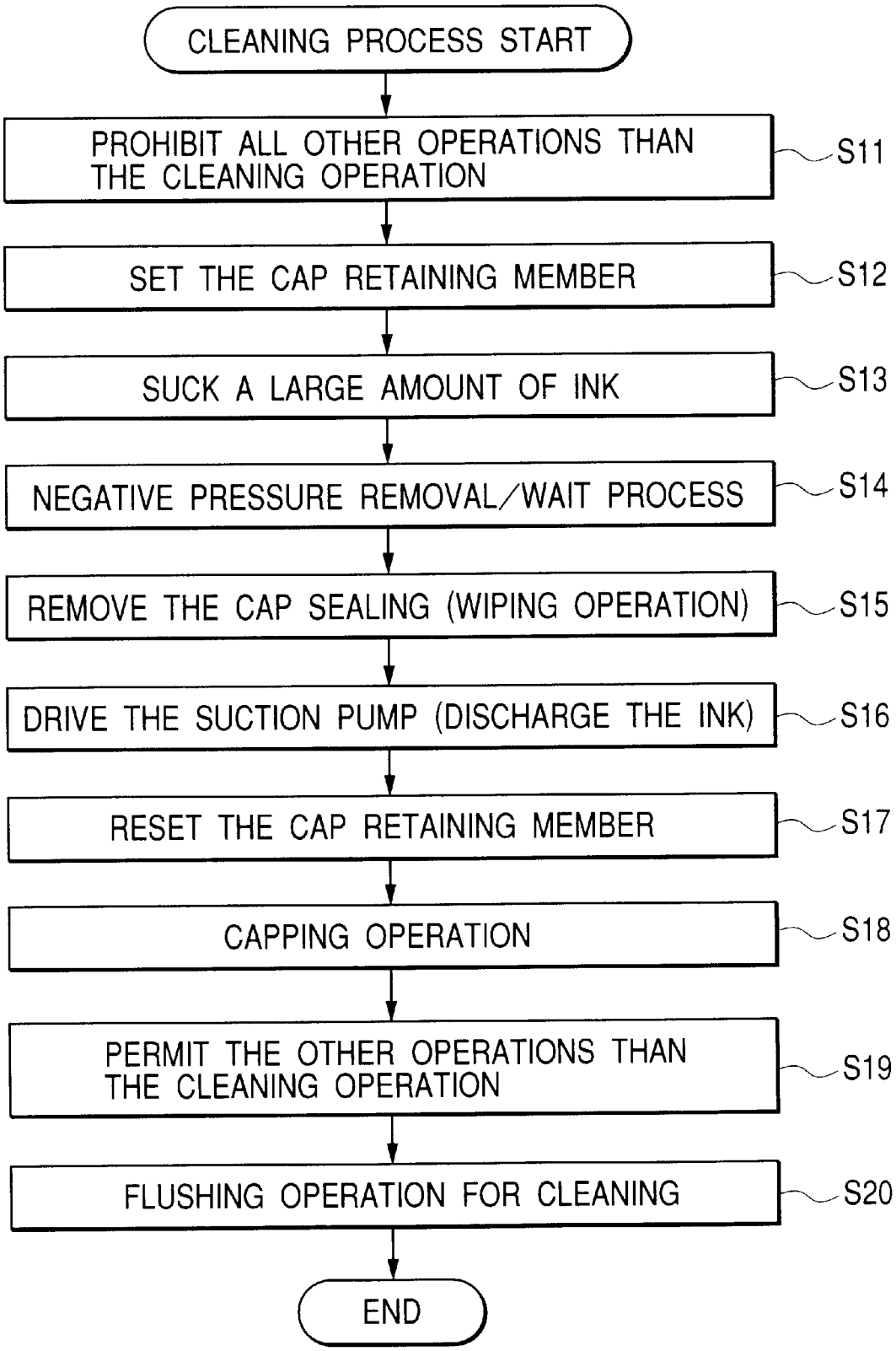
FIG. 10 is a flow chart for explaining a method for driving and controlling the recording device of the first embodiment of the invention.

FIG. 10 shows a control sequence for explaining a method for driving and controlling the recording device thus constructed, in particular a wiping control method for the recording head. Upon start of a cleaning process, all other operations, e.g., a paper feeding operation, than the operations necessary for a cleaning process are prohibited (step S11). In this case, the carriage 1 has been moved to a capping position as shown in FIG. 7. In this state, the cap retaining member 50 is moved upward and set there (step S12). The setting of the cap retaining member is performed in connection with the tube pump 12.

Through the suction operation of the tube pump 12, a negative pressure is applied to the inside of the cap member 10, and a large amount of ink is sucked from the recording head (step S13). As a result, the ink is discharged from the recording head 15. Then, a negative pressure release waiting process 20 is executed (step S14). In this step, the sealing of the nozzle forming surface of the recording head 15 by the cap member 10 is maintained till a predetermined time taken for the inner space of the cap member 10 to resume the pressure equal to atmospheric pressure. In this waiting step, a predetermined amount of ink is discharged from the recording head, and the negative pressure in the inner space of the cap member 10 is substantially equal to atmospheric pressure.

When the pressure within the cap member 10 becomes substantially equal to atmospheric pressure, the sealing of the nozzle forming surface of the recording head by the cap member 10 is removed. This is realized by the movement of the carriage 1 to the print region. The cap holder 31 forming the capping unit 9 is brought into engagement with the cap retaining member 50 being placed to a set state. This state is shown in FIG. 8.

With further movement of the carriage 1 toward the print region, the wiping member 11 standing erect on the cap holder 31 (FIG. 9) slides on the nozzle forming surface to wipe (step 515) the nozzle forming surface. Subsequently, the tube pump 12 is driven (step S16) to cause the cap member 10 to discharge ink therefrom.

The cap retaining member 50 is moved down to be placed to a reset state (step S17). Then, the carriage 1 is moved again to the home position, and the capping operation (step 518) is performed. In this case, the cap retaining member 50 is put in the reset state. Accordingly, the operation of capping the recording head with the capping unit 9 is not hindered.

Subsequently, the other operations than the cleaning process, which have been prohibited, are permitted (step S19). A waiting state is set up in a state that the flushing operation (step 520) for cleaning is being performed, and the cleaning operation ends.

In the embodiment, during the returning movement of the capping unit, the cap retaining member 50 comes in contact with the cap holder 31 forming the capping unit to stop the backward movement of the capping means. If required, such an arrangement may be adopted that the cap retaining member 50 comes in contact with the capping unit, thereby to block the returning movement of the capping unit.

The drive unit shown in FIGS. 6 to 9 employs the capping unit shown in FIG. 4. Where the capping unit shown in FIG. 5 is employed, the ink receiving recess 35 maybe given a function to capture ink drops in the flushing operation in which a drive signal not related to the printing is applied to the recording head to cause the head to eject ink drops.

In this case, in performing the flushing operation, control is made such that the nozzle openings of the recording head 15 selectively eject ink drops. And the recording head 15 moves and the nozzle openings passing just above the ink receiving recess 35 successively idle eject ink drops. Accordingly, the ink drops idle ejected by the flushing operation are reliably captured by the ink receiving recess 35. Where the ink drops are idle ejected, by flushing, to the ink receiving recess 35 while moving the recording head 15, the throughput of the device is improved.

Second Embodiment

Another recording device which is a second embodiment of the present invention will be described with reference to FIGS. 11 to 17. A basic construction of the overall recording device of the second embodiment is similar to that already stated and shown in FIG. 1. In the second embodiment, a unit including the cap member 10 and the wiping member 11 shown in FIG. 1 will be referred to as a head cleaning mechanism 61. When the recording head 15 is moved from the print region to the non-print region (home position), the head cleaning mechanism 61 is located at a position where it is confronted with the nozzle forming surface 15*a* of the recording head 15. In this state, the head cleaning mechanism 61 carries out a cleaning process.

Figure 11:
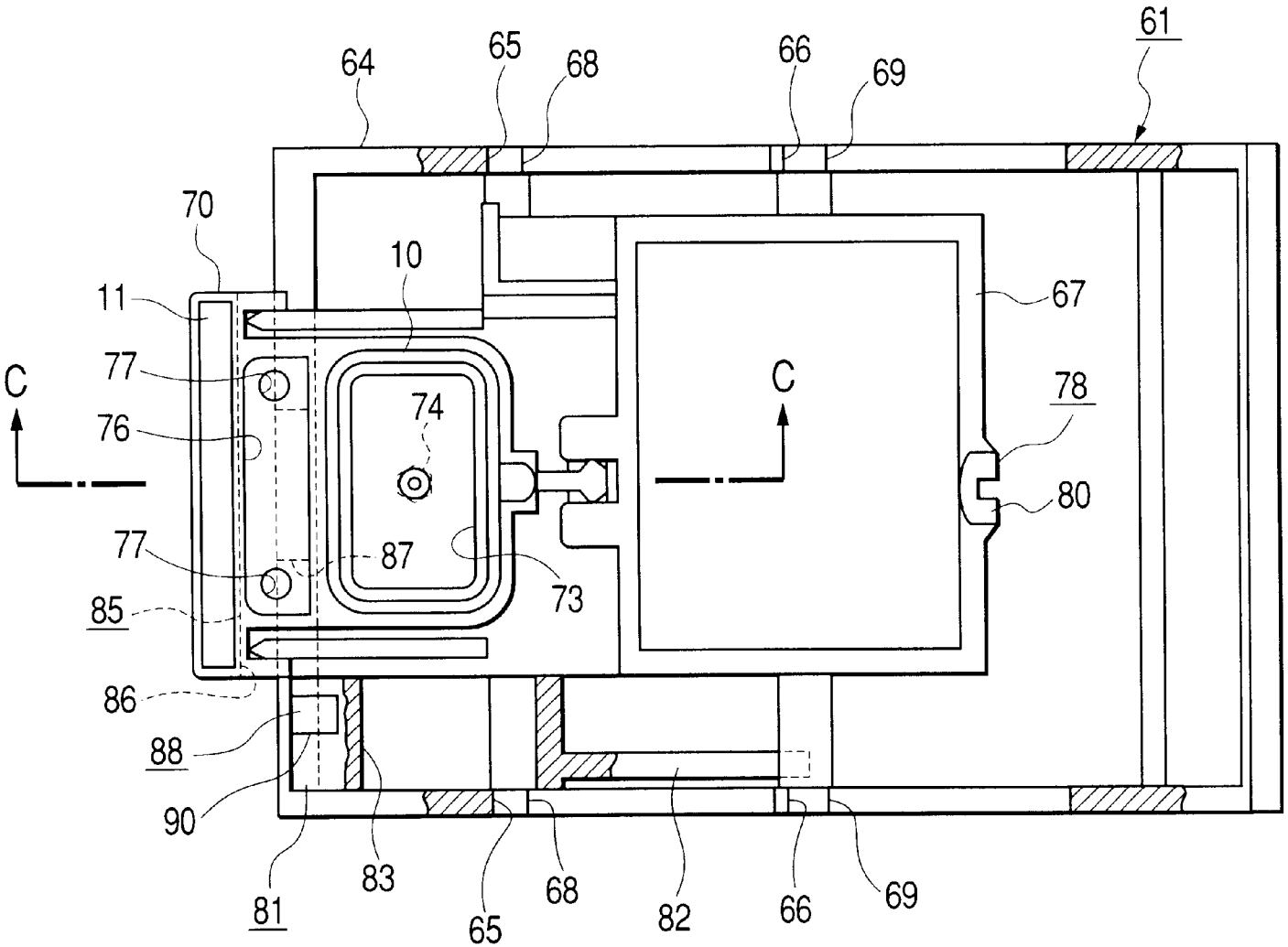
FIG. 11 is an enlarged, plan view showing a head cleaning mechanism employed in a recording device forming a second embodiment of the invention.
Figure 12:
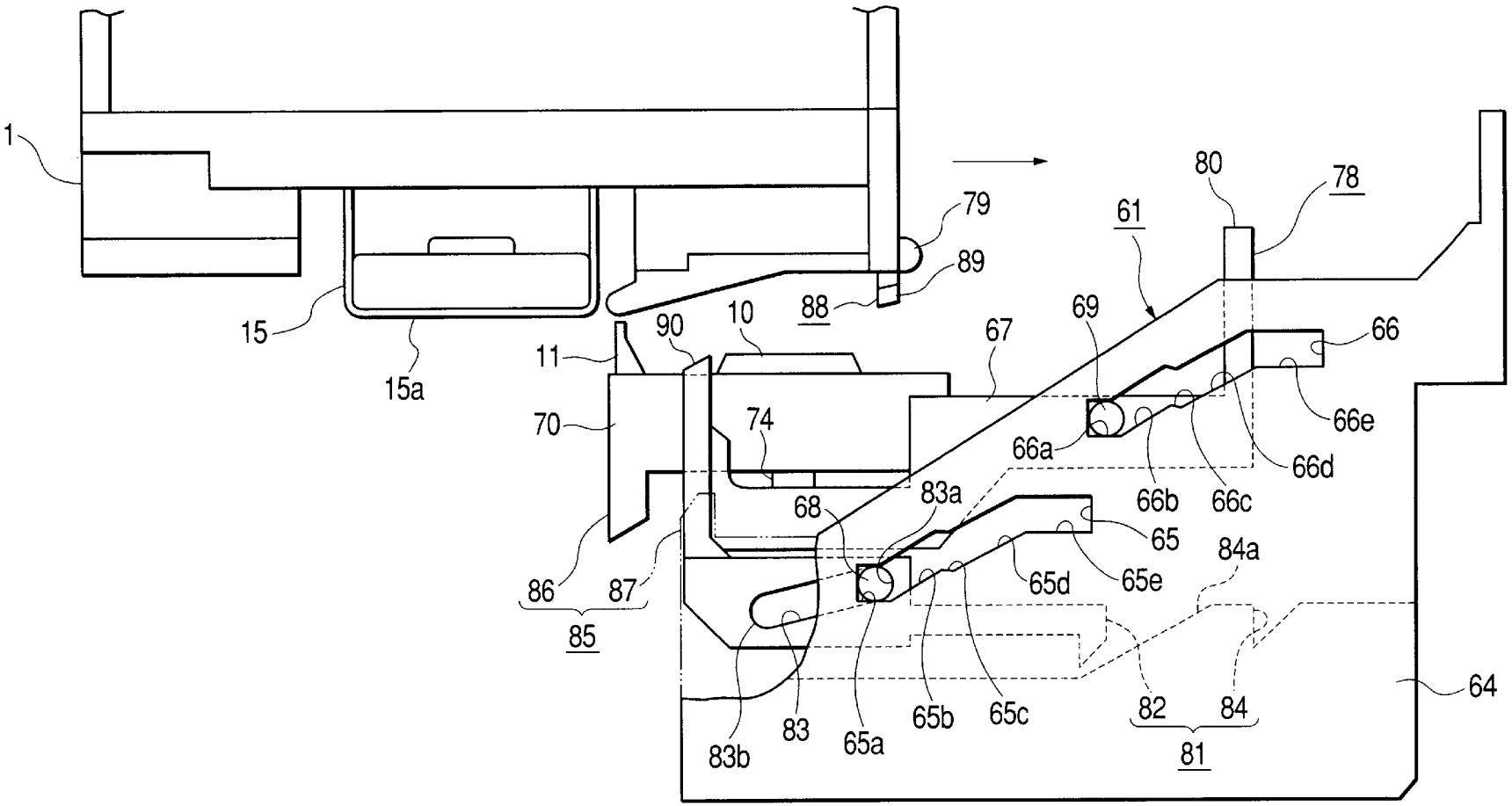
FIG. 12 is a side view showing the head cleaning mechanism.
Figure 13:
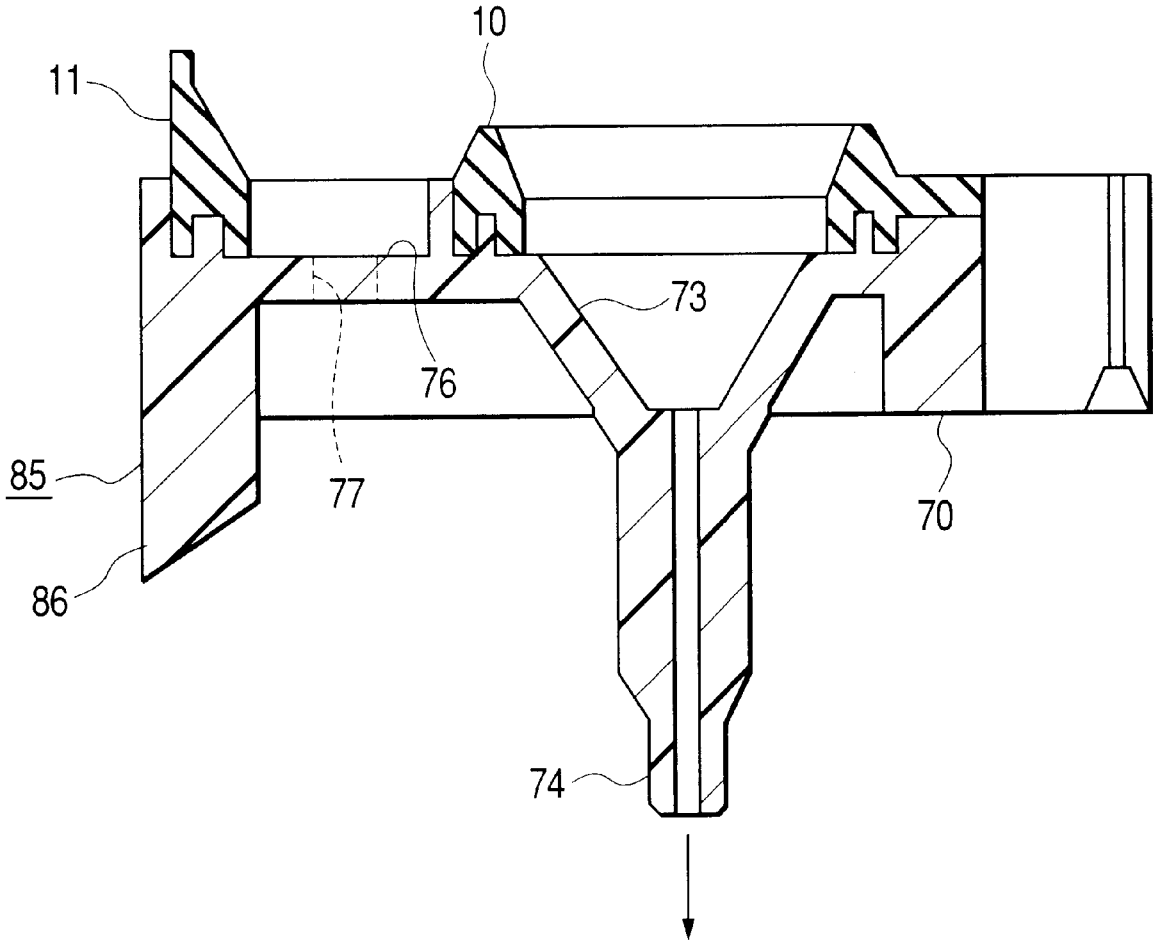
FIG. 13 is a cross sectional view taken on line C—C in FIG. 11 when viewed in the direction of arrow.
Figure 14:
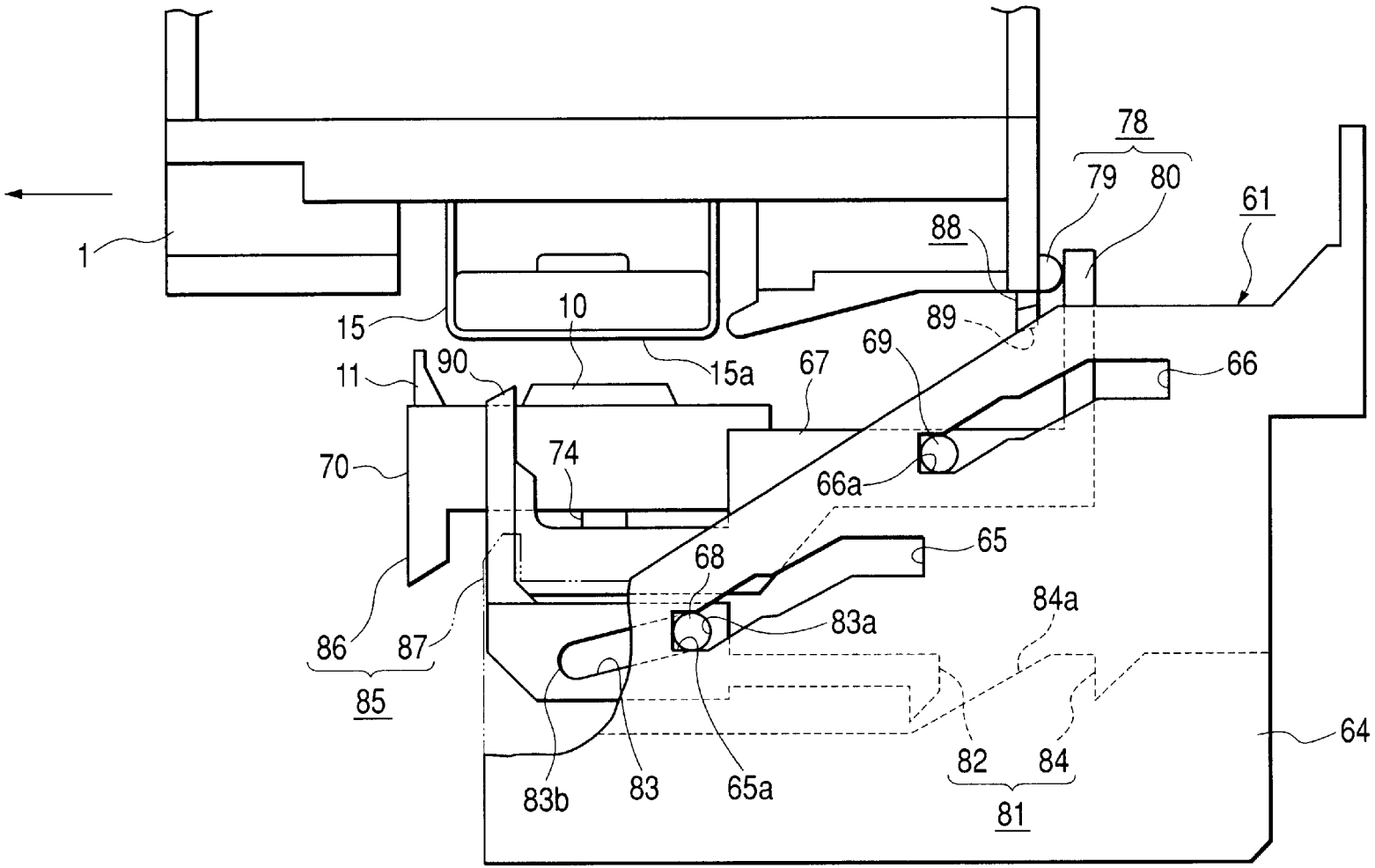
FIG. 14 is a side view showing the head cleaning mechanism in the second embodiment when it is in a flushing mode.

A construction of the head cleaning mechanism 61 will be described in detail hereunder. FIG. 11 is a plan view showing the head cleaning mechanism 61. FIG. 12 is a side view showing the head cleaning mechanism 61. FIG. 13 is a cross sectional view showing the capping unit taken on line C—C in FIG. 11. FIGS. 14 to 17 are side views showing the head cleaning mechanism 61, those views showing a state of the movement of the slider as in FIG. 12.

As shown in FIGS. 11 and 12, a bracket 64 is fixed to a position adjacent to the home position of the recording head 15. A pair of guide grooves 65 and 66 are formed in opposite side walls of the bracket 64 and extend in the movement direction of the recording head 15. The guide groove 65 (66) includes a horizontal lower part 65*a* (66*a*), a first slanted part 65*b* (66*b*), a horizontal medium part 65*c* (66*c*), a second slanted part 65*d* (66*d*), and a horizontal upper part 65*e* (66*e*), those parts being continuous. Those guide grooves 65 and 66 are formed as cams.

A slider 67 as a member to be driven is disposed on the bracket 64 such that a pair of support pins 68 and 69 protruded from opposite side walls of the slider are inserted into the guide grooves 65 and 66, respectively. The slider 67 thus disposed is supported to be movable along the guide grooves 65 and 66 in the moving direction of the recording head 15 and in the vertical direction in which the slider moves to and from the nozzle forming surface 15*a* of the recording head 15. The support pins 68 and 69 are formed as cam followers. The guide grooves 65 and 66 and the support pins 68 and 69 form a converting unit for converting the movement of the carriage 1 into the approaching and withdrawing movements of a cap holder 70 to be described later. A spring member (not shown) is provided between the slider 67 and the bracket 64. The spring member urges the slider 67 to the print region side (the left side in FIG. 12) and to the lower side of the recording head 15.

The cap holder 70 is supported on the slider 67, is vertically movable, and is urged upward by a spring member (not shown). As shown in FIGS. 11 and 13, a square-frame like cap member 10 and a strip-like wiping member 11 are projected upward from the cap holder 70. The cap member 10 comes in contact with the outer periphery of the nozzle forming surface 15*a* of the recording head 15 to seal up the nozzle forming surface 15*a*. The wiping member 11 slides on the nozzle forming surface 15*a* of the recording head 15 to wipe the nozzle forming surface 15*a*. In the process of molding the cap holder 70, the cap member 10 and the wiping member 11 are formed integral with the cap holder 70 using one and the same soft material, e.g., elastomer, by two-color molding.

As shown in FIG. 13, the outer peripheral edge of the cap member 10 is triangle in cross section, and brought into elastic and close contact with the nozzle forming surface 15*a* of the recording head 15, so that the inner space of the cap member 10 is hermetically closed. The upper end edge of the wiping member 11 is also triangle in cross section, and is brought into sliding contact with the nozzle forming surface 15*a* of the recording head 15, while being elastically deformed. As a result, the nozzle forming surface 15*a* is wiped out satisfactorily. A funnel-shaped ink discharging port 73 is formed in the cap holder 70 at a location corresponding to the cap member 10. A connecting pipe 74 is coupled to the bottom end of the ink discharging port.

A suction pump 12 is disposed under the slider 67, as shown in FIG. 1, and connected to the connecting pipe 74 via a suction pipe (not shown). A negative pressure is applied from the suction pump 12 to the inner space of the cap member 10 in a state that the nozzle forming surface 15*a* of the recording head 15 is sealed with the cap member 10. The ink is sucked and discharged from the recording head 15.

As shown in FIG. 13, an ink receiving recess 76 is formed on the upper surface of the cap holder 70 at a location between the cap member 10 and the wiping member 11. A pair of ink discharge holes 77 are formed in the bottom of the ink receiving recess and pass therethrough. Waste ink on the nozzle forming surface 15*a* of the recording head 15 that is wiped out by the wiping member 11 is received by the ink receiving recess 76, and discharged out through the ink discharge holes 77. Smear by the waste ink can be prevented by providing the waste ink absorbing member (not shown) under the ink discharge holes 77.

As shown in FIGS. 11 and 12, an interlocking mechanism 78 is provided between the carriage 1 and the slider 67. The interlocking mechanism 78 includes an engaging piece 79 protruded from the lower end of the carriage 1 at the home position side, and an engaged part 80 which is to be engaged with the engaging piece and rises from the slider 67.

Figure 15:
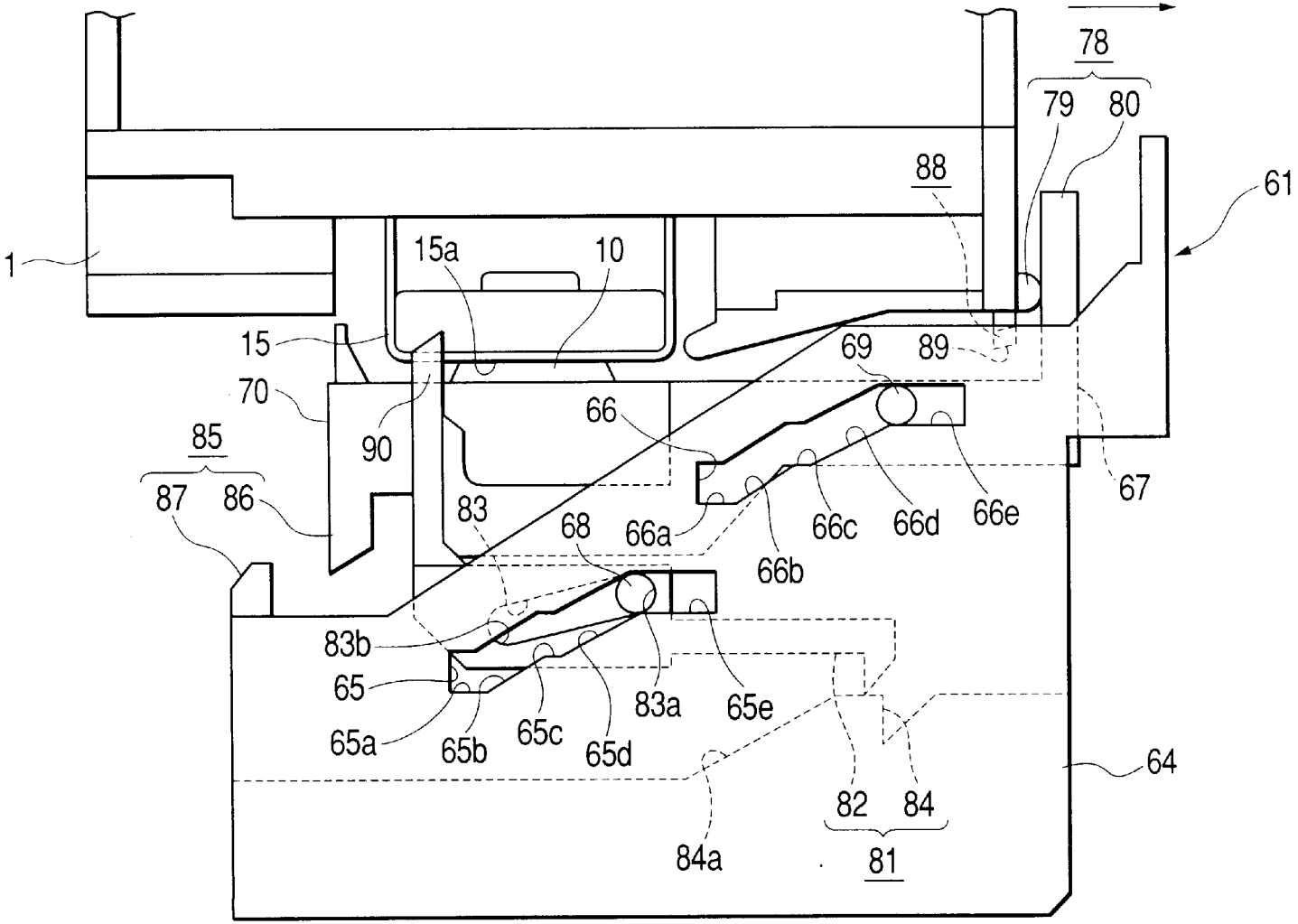
FIG. 15 is a side view showing the head cleaning mechanism when it is in a capping mode.
Figure 16:
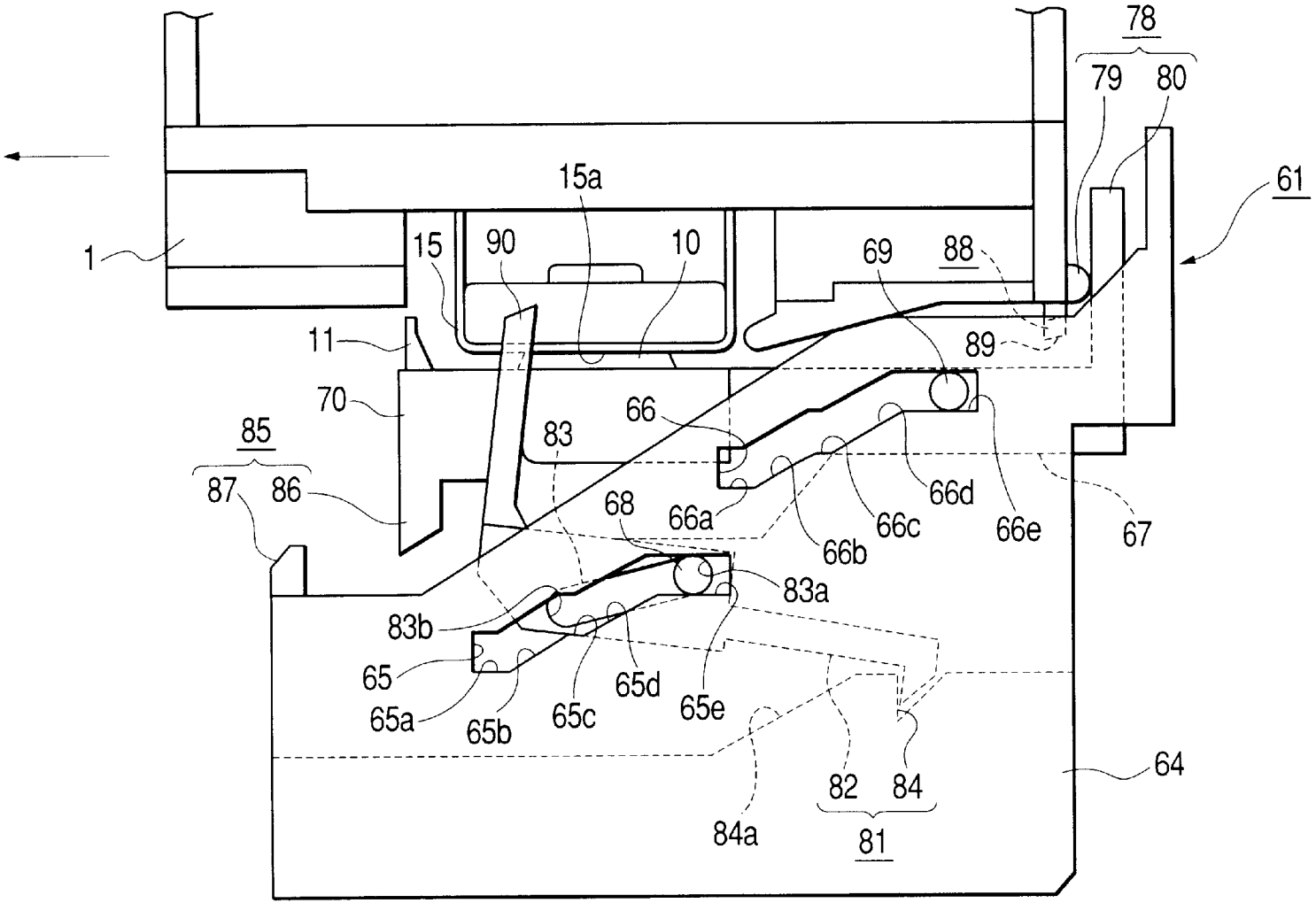
FIG. 16 is a side view showing the head cleaning mechanism when it is in a suction mode.

When the recording head 15 is moved together with the carriage 1 from the print region shown in FIG. 12 into the home position shown in FIG. 15, the engaging piece 79 is brought into contact with the engaged part 80 of the interlocking mechanism 78, and the slider 67 together with the cap holder 70 is moved in the same direction against the urging force of a spring member (not shown). In this case, the support pins 68 and 69 on the opposite sides of the slider 67 are moved from the horizontal lower parts 65*a* and 66*a* to the horizontal upper parts 65*e* and 66*e* by way of the first slanted parts 65*b* and 66*b*, the horizontal medium parts 65*c* and 66*c* and the second slanted parts 65*d* and 66*d*. As a result, the slider 67 and the cap holder 70 are moved to a higher position near the nozzle forming surface 15*a* of the recording head 15, and the cap member 10 is brought into contact with the nozzle forming surface 15*a* to seal up it.

Conversely, when the recording head 15 is moved together with the carriage 1 backward from the home position shown in FIG. 15 to the print region shown in FIG. 12, the slider 67 is moved together with the cap holder 70 in the same direction by the urging force of a spring member (not shown). In this case, the support pins 68 and 69 of the slider 67 which are engaged with the guide grooves 65 and 66 are moved from the horizontal upper parts 65*e* and 66*e* of the guide grooves to the horizontal lower parts 65*a* and 66*a* by way of the second slanted parts 65*d* and 66*d*, the horizontal medium parts 65*c* and 66*c*, and the first slanted parts 65*b* and 66*b*. As a result, the slider 67 and the cap holder 70 are moved downward to separate from the nozzle forming surface 15*a* of the recording head 15, and the cap member 10 separates from the nozzle forming surface 15*a* to remove the sealing thereof.

As shown in FIGS. 11 and 12, a holding mechanism 81 serving as a locking unit is provided between the slider 67 and the bracket 64. The holding mechanism 81 includes a holding pawl 82 and an engaging part 84. The holding pawl 82 is relatively movably and rotatably supported on one of the support pins 68 of the slider 67 through an elongated hole 83 formed through the holding pawl. The engaging part 84 is provided on the bracket 64 such that the engaging part may engage with the holding pawl 82 and disengage from the same. The holding pawl 82 is urged, by a spring member (not shown), to move to the print region of the recording head 15 (to the left in FIG. 12), and urged to rotate clockwise in FIG. 12.

When the recording head 15 is moved together with the carriage 1 from the home position (FIG. 15) to the suction position (FIG. 16), the holding pawl 82 is engaged with the engaging part 84 in a state that the support pin 68 comes in contact with a first end 83*a* of the elongated hole 83 of the holding pawl 82. In this case, the holding pawl 82 is guided by a guide surface 84*a* and reaches the engaging part 84. In this state, the sucking and discharging operations of ink from the recording head 15 under the negative pressure from the suction pump 12 are performed.

When the recording head 15 is moved together with the carriage 1 from the suction position (FIG. 16) to the print region (FIG. 12) after the sucking and discharging operation, the slider 67 and the cap holder 70 are moved in the same direction by the urging force of a spring member (not shown).

In this case, the support pins 68 and 69 of the slider 67 which engaged with the guide grooves 65 and 66 are moved from the horizontal upper parts 65*e* and 66*e* to the horizontal medium parts 65*c* and 66*c* by way of the second slanted parts 65*d* and 66*d*. As a result, the slider 67 and the cap holder 70 are moved downward to a mid position where those detach from the nozzle forming surface 15*a* of the recording head 15, whereby the sealing of the nozzle forming surface 15*a* by the cap member 10 is removed. With this, the wiping member 11 is moved to a wiping position where it is in sliding contact with the nozzle forming surface 15*a*.

In this state, the support pin 68 comes in contact with a second end 83*b* of the elongated hole 83 of the holding pawl 82, and the slider 67 and the cap holder 70 are held at the mid position by the holding pawl 82 engaged with the engaging part 84. When the recording head 15 is moved together with the carriage from the wiping position (FIG. 17) to the print region (FIG. 12), the wiping member 11 comes in sliding contact with the nozzle forming surface 15*a* of the recording head 15 to wipe the nozzle forming surface 15*a*.

As shown in FIGS. 11 to 13, a restriction mechanism 85 is provided between the cap holder 70 and the bracket 64. The restriction mechanism 85 includes an engage protruding part 86 and an engaged protruding part 87. The engage protruding part 86 is protruded downward from the lower surface of the cap holder 70 at a position just under the wiping member 11. The engaged protruding part 87 is protruded upward from the upper surface of the end of the bracket 64, and is capable of engaging with and disengaging from the engage protruding part 86.

When the recording head 15 is moved together with the carriage 1 to the home position (FIG. 17), the engage protruding part 86 of the restriction mechanism 85 engages with the engaged protruding part 87. The engage protruding part 86 is located at a position where it is confronted with the top of the engaged protruding part 87. With this structure, even if a pressing force is exerted on the cap holder 70 in the downward direction during the wiping of the nozzle forming surface 15*a* of the recording head 15 by the wiping member 11, a downward displacement of the cap holder 70 is restricted, thereby maintaining a state that the wiping member 11 is in sliding contact with the nozzle forming surface 15*a*.

The faces of the engage protruding part 86 and the engaged protruding part 87 at which those parts engage with each other are slanted. Because of the slanting of those faces, when the cap holder 70 is moved in the moving direction of the recording head 15, or to the left direction as shown in FIGS. 11 to 17, those parts easily disengage from each other. When a force is exerted on the wiping member 11 in the downward direction, the engagement between the engaging protruding part 86 and the engaged protruding part 87 is maintained against the force.

As shown in FIGS. 11 and 12, a disengaging mechanism 88 forming a disengaging unit is provided between the carriage 1 and the holding pawl 82. The disengaging mechanism 88 includes an engaging part 89 and an engaged part 90. The engaging part 89 is protruded from the lower end of the carriage 1, which is closer to the home position. The engaged part 90 is protruded upward from the holding pawl 82 at a position where it is capable of engaging with and disengaging from the engaging part 89.

The recording head 15 is moved together with the carriage 1 from the home position (FIG. 17) to the print region (FIG. 12), and then the wiping operation of the nozzle forming surface 15*a* by the wiping member 11 is finished. At this time, the engaging part 89 of the disengaging mechanism 88 engages with the engaged part 90. In turn, the holding pawl 82 is turned counterclockwise to disengage from the engaging part 84 and to release the slider 67 and the cap holder 70 from being engaged, and are moved and returned to the original position shown in FIG. 12 by the urging force of a spring member (not shown).

Also in the embodiment, after the recording head 15 makes the recording on the recording sheet 6 by a predetermined number of lines or a predetermined number of sheets, the recording head 15 is moved together with the carriage 1 from the print region (FIG. 12) to the flushing position (FIG. 14) just before the home position (FIG. 15). In this case, the engaging piece 79 of the interlocking mechanism 78 is not engaged with the engaged part 80, and the cap holder 70 is located at a lower position without moving upward along the guide grooves 65 and 66. And, the cap member 10 is located just under the nozzle forming surface 15*a* of the recording head 15.

In this state, a drive signal not related to the print data is applied to the recording head 15, and the recording head 15 idle-ejects ink drops to the cap member 10. The so-called flushing operation is performed. After the flushing operation is finished, the recording head 15 is moved together with the carriage 1 from the home position (FIG. 14) to the print region (FIG. 12), and the recording head 15 starts the printing again. In this case, the cap holder 70 is at the lower position, and the wiping member 11 is located while being separated from the nozzle forming surface 15*a* of the recording head 15, whereby inhibiting the wiping of the nozzle forming surface 15*a* by the wiping member 11.

An operation of the head cleaning mechanism 61 in the ink jet recording device thus constructed will now be described. The operation of cleaning the recording head 15 is performed when the recording device having been left not used for a long time starts again its operation, when the user recognizes a printing failure and operates a cleaning switch, and in other situations. In the cleaning operation, the recording head 15 is moved together with the carriage 1 to the home position (FIG. 15), from the print region (FIG. 12). The slider 67 and the cap holder 70 are moved to a higher position with the aid of the interlocking mechanism 78 and the guide grooves 65 and 66. As a result, the cap member 10 is brought into contact with the nozzle forming surface 15*a* of the recording head to seal up the nozzle forming surface 15*a*.

Subsequently, the recording head 15 is further moved from the home position (FIG. 15) to the suction position (FIG. 16), and the holding pawl 82 of the holding mechanism 81 is engaged with the engaging part 84. Accordingly, in this state, the cap holder 70 is stably held at the suction position, and a negative pressure is applied to the inner space of the capmember 10. In turn, the ink is sucked and discharged from the recording head 15 to remove the clogging of the nozzle openings of the recording head.

When the recording head 15 is moved from the suction position (FIG. 16) toward the print region (FIG. 12), and reaches the wiping position (FIG. 17), the slider 67 and the cap holder 70 is lowered to the mid position through the guide grooves 65 and 66, and it is held at the mid position by the holding mechanism 81. As a result, the sealing of the nozzle forming surface 15*a* by the cap member 10 is removed, and the wiping member 11 is located at the wiping position where it may be in sliding contact with the nozzle forming surface 15*a* of the recording head 15, and held thereat.

When the recording head 15 is moved from the wiping position (FIG. 17) to the print region (FIG. 12), the nozzle forming surface 15*a* of the carriage 15 is wiped out.

Figure 17:
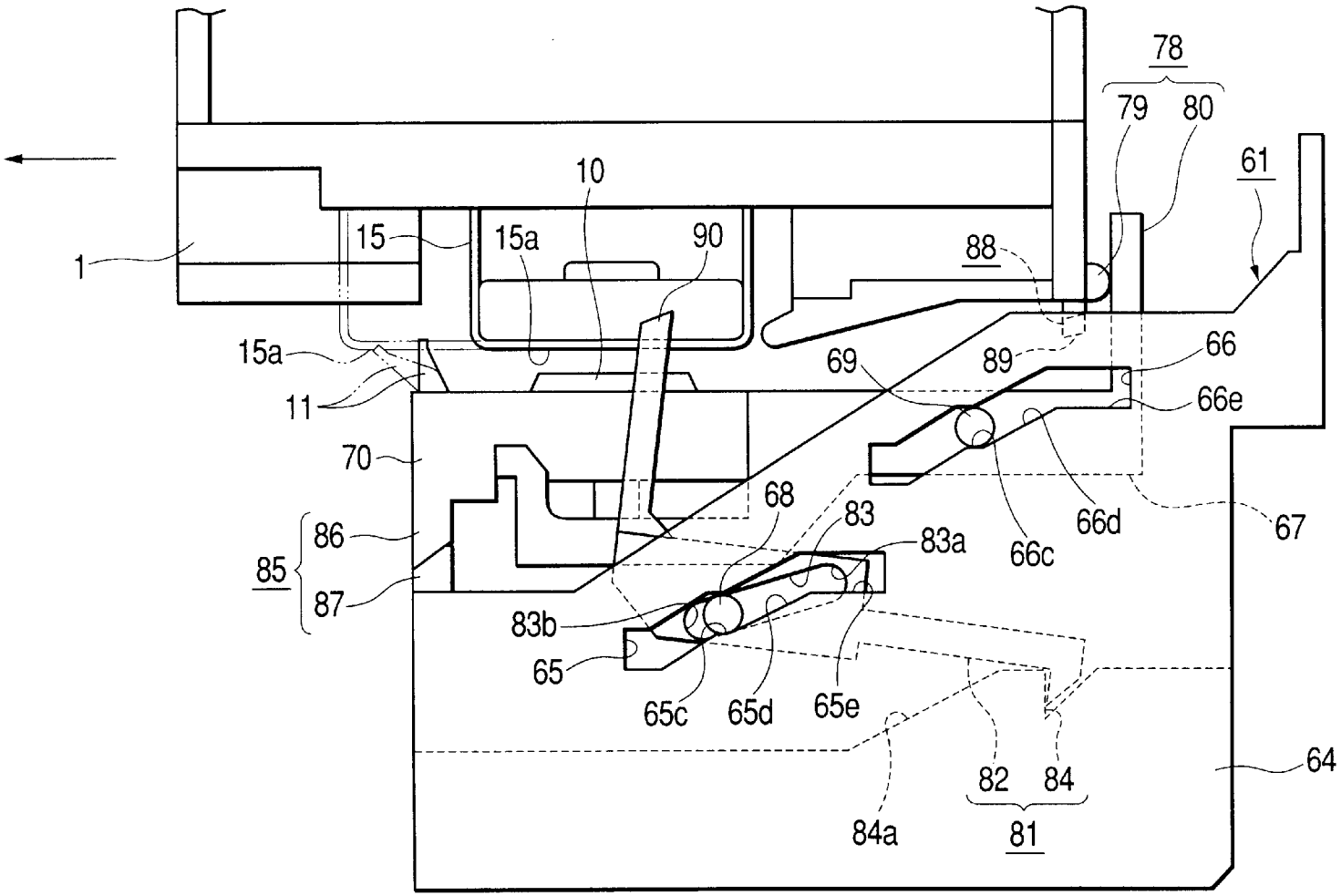
FIG. 17 is a side view showing the head cleaning mechanism when it is in a wiping mode.

When the nozzle forming surface 15*a* is being wiped by the wiping member 11, the engage protruding part 86 of the limiting mechanism 85 engages with the engaged protruding part 87 to restrict the downward movement of the cap holder 70 (FIG. 17). Therefore, even if the downward pressing force acts the cap holder 70, there is no chance that the wiping member 11 separates from the nozzle forming surface 15*a*, viz., it maintains its sliding contact state. And, the cleaning of the nozzle forming surface 15*a* is reliably performed with the elasticity of the wiping member 11.

Thereafter, the engaging part 89 of the disengaging mechanism 88 is engaged with the engaged part 90 during the movement of the recording head 15 toward the print region, and the holding pawl 82 is turned counterclockwise in FIG. 17 to disengage from the engaging part 84. By this, the slider 67 and the cap holder 70 are released from their engaging and holding state, and are moved to the original position shown in FIG. 12 by the urging force of a spring member (not shown).

In the ink jet recording device of the second embodiment, the recording head 15 is moved from the print region (FIG. 12) to the flushing position (FIG. 14) every time the recording head 15 makes the recording on the recording sheet 6 by a predetermined number of lines or a predetermined number of sheets. The flushing position is located just before the home position (FIG. 15). Accordingly, the cap holder 70 is located in the lower position without being lifted, through the action of the guide grooves 65 and 66. Accordingly, the cap member 10 is located just under the nozzle forming surface 15*a* of the recording head 15. And the wiping member 11 is located at a position where it is not in contact with the nozzle forming surface 15*a* of the recording head 15.

In this state, a drive signal not related to the print data is applied to the recording head 15, and the recording head 15 idle-ejects ink drops to the cap member 10, thereby carrying out the flushing. Thereafter, the recording head 15 is moved from the flushing position (FIG. 14) to the print region (FIG. 12) without performing the wiping of the nozzle forming surface 15*a* by the wiping member 11, and the recording operation by the recording head 15 is performed.

Accordingly, the recording device of the second embodiment produces the following useful effects.

(1) In the ink jet recording device, when the recording head 15 is moved to the home position, the cap holder 70 is moved to make an approach to the nozzle forming surface 15*a* of the recording head 15 through the interlocking mechanism 78, and then the nozzle forming surface 15*a* of the recording head 15 is sealed with the cap member 10. In this state, a negative pressure is applied from the suction pump 12 into the cap member 10. Ink is sucked and discharged from the recording head 15 to remove the clogging of the nozzle openings. At this time, the cap holder 70 is held, by the holding mechanism 81, at a position where the wiping member 11 is brought into sliding contact with the nozzle forming surface 15*a* of the recording head 15. When the recording head 15 is moved from the home position after the ink sucking and discharging by the suction pump 12, the wiping member 11 is brought into sliding contact with the nozzle forming surface 15*a* of the recording head 15 to wipe the nozzle forming surface 15*a*. Therefore, there is no case that the nozzle forming surface 15*a* of the recording head 15 is wiped in a state that the nozzle forming surface 15*a* is dried. Before the wiping operation, the ink is sucked and discharged from the recording head 15, and the nozzle forming surface 15*a* is wiped in a state that it is wet with the ink. For this reason, there is no chance that the nozzle forming surface 15*a* is wiped in a state that it is dry, and is possibly damaged.

(2) In the ink jet recording device, the cap member 10 and the wiping member 11 are made of one and the same soft material. Therefore, in the process of molding the cap holder 70, those members may easily be formed using the same material by two-color molding. In the process of molding the cap holder 70, the cap member 10 and the wiping member 11 are formed integral with the cap holder 70 using one and the same soft material, by two-color molding. The cap member 10 and the wiping member 11 are formed on the cap holder 70 by one-piece molding, and in this state those members may easily be assembled to a position near the home position of the recording head 15.

(3) This ink jet recording device is provided with the restriction mechanism 85 for restricting the moving of the cap holder 70 apart from the nozzle forming surface 15*a* during the cleaning of the nozzle forming surface 15*a* of the recording head 15 by the wiping member 11. With provision of the restriction mechanism, even if a downward pressing force is exerted on the cap holder 70 during the cleaning of the nozzle forming surface 15*a* by the wiping member 11, the restriction mechanism 85 restricts the downward displacement of the cap holder 70, whereby the wiping member 11 is held in a state that it is in slide contact with the nozzle forming surface 15*a*. Therefore, the wiping member 11 reliably cleans the nozzle forming surface 15*a*.

(4) In the ink jet recording device, the recording head 15 is moved to a position just before the home position, and idle-ejects ink drops to carry out the flushing in a state that the cap member 10 on the cap holder 70 is not in contact with the nozzle forming surface 15*a* of the recording head 15. Thereafter, the recording head 15 is moved backward from the position just before the home position in a state that the wiping member 11 is not in contact with the nozzle forming surface 15*a* of the recording head 15. For this reason, when the recording head 15 idle-ejects ink drops to execute the flushing, and then the recording head 15 is moved backward from the position just before the home position, the cleaning of the nozzle forming surface 15*a* in which the wiping member 11 is brought into sliding contact with the nozzle forming surface 15*a*, is not carried out. Accordingly, possibility of damaging the nozzle forming surface 15*a* due to wiping the nozzle forming surface 15*a* in dry state after the flushing is further lessened.

(5) In the ink jet recording device, the guide grooves 65 and 66 forming cams are used for a mechanical arrangement for moving the cap holder 70 to and from the nozzle forming surface 15*a*. The cleaning of the nozzle forming surface 15*a* is reliably performed with an extremely simple construction.

Modifications

The embodiment of the present invention may be modified as follows.

The second embodiment may be modified such that the holding pawl 82 of the holding mechanism 81 is rotatably supported on the slider 67. When the slider 67 or the cap holder 70 is moved backward from the home position (FIG. 15) to the wiping position (FIG. 17), the holding pawl 82 is engaged with the engaging part 84 on the bracket 64, and the slider 67 and the cap holder 70 are held at the mid position.

The second embodiment may also be modified in the following way. The holding pawl 82 of the holding mechanism 81 is formed integrally with the slider 67. When the slider 67 and the cap holder 70 are moved from the home position (FIG. 15) to the wiping position (FIG. 17), the holding pawl 82 is engaged with the engaging part 84 on the bracket 64, and the slider 67 and the cap holder 70 are held at the mid position. In this case, the slider 67 should be rotatably supported on the bracket 64 such that it is rotatable about the support pin 68, and the holding pawl 82 is disengaged from the engaging part 84 when the slider 67 is turned.

Further, the second embodiment may be modified as follows. An engaging retaining member being movable to the moving path of the slider 67 is used for the holding mechanism 81. When the slider 67 and the cap holder 70 are moved backward from the home position (FIG. 15) to the wiping position (FIG. 17), the engaging retaining member is engaged with the slider 67, and the slider 67 and the cap holder 70 are held at the mid position. This modification also produces the useful effects comparable with those in the above-mentioned embodiment.

In the second embodiment, the cap member 10 and the wiping member 11 are formed on the cap holder 70 by two-color molding. In an alternative, only one of those members is formed by the two-color molding, and the other is bonded to the cap holder. In another alternative, both the members are bonded to the same.

In the second embodiment, the restriction mechanism 85 maybe omitted. In this case, an urging member, e.g., a spring, for urging upward the wiping member 11 is preferably used instead.

As seen from the foregoing description, in the ink jet recording device of the invention, a cap member which is brought into contact with a nozzle forming surface of a recording head and a wiping member which slides on said nozzle forming surface of the recording head to wipe the nozzle forming surface, are disposed on a cap holder. Therefore, the related drive unit for horizontally driving the wiping member may be omitted. This feature of the invention accrues to various advantages, such as structure simplification and reduction of device size and cost.

In a drive and control method for the invention, during the backward movement of the capping unit, which is caused by and progresses concurrently with the movement of the carriage to the print region, the backward movement of the capping unit is selectively halted by the cap retaining member. Decision as to whether or not the wiping operation is to be performed may be made by a simple mechanism, and the deciding operation is reliable.

Further, the nozzle forming surface is not wiped by the wiping member in a state that the surface is in a dry. Accordingly, the invention successfully prevents such an unwanted situation that the nozzle forming surface is wiped in a dry state to possibly be damaged.

What is claimed is:

1. An ink jet recording device including an ink jet recording head which is mounted on a carriage being reciprocatively movable from a print region to a home position, ejects ink drops in accordance with print data and includes a nozzle forming surface, the ink jet recording device comprising:

a capping unit which seals up the nozzle forming surface and is capable of sucking and discharging ink from the recording head under a negative pressure received from a suction pump, the capping unit including, a drive unit controlled so as to approach and separate from the nozzle forming surface, a cap holder mounted on the drive unit, a cap member which is disposed on the cap holder and is capable of being brought into contact with the nozzle forming surface with a movement of the drive unit for sealing up the nozzle forming surface, a wiping member which is mounted on the cap holder at a side of the print region and is slidably contactable on the nozzle forming surface, and a cap retaining member which is selectively moved to and from a moving path of the cap holder and is capable of blocking a movement of the cap holder when the cap holder moves.

2. The ink jet recording device according to claim 1, wherein an ink receiving recess is provided between the cap member and the wiping member.

3. The ink jet recording device according to claim 2, wherein the ink receiving recess is formed integrally with the cap holder holding the cap member and the wiping member.

4. The ink jet recording device according to claim 1, wherein the cap holder moves forward toward the nozzle forming surface in conjunction with a movement of the carriage toward the home position, so that the nozzle forming surface is sealed with the cap member, the cap holder moves backward from the nozzle forming surface in conjunction with the movement of the carriage toward a print region, so that the sealing of said nozzle forming surface by said cap member is removed, the cap holder is retained by the cap retaining member having advanced to the moving path of the cap holder during the backward movement of the cap holder, and the wiping member held by the cap holder is brought into sliding contact with the nozzle forming surface in a state that the cap holder is retained.

5. The ink jet recording device according to claim 4, wherein the cap holder receives a drive force of the carriage with the movement of the carriage to the home position and responsively moves in an oblique and upward direction when the carriage is moved forward to the home position, the cap holder receives the drive force of the carriage with the movement of the carriage toward the print region and responsively moves backward in an oblique and downward direction when the carriage is moved toward the print region, and the cap holder is stopped moving in a downward direction by the cap retaining member having advanced to the moving path of the cap holder during which the cap holder moves backwards in the oblique and downward direction.

6. The ink jet recording device according to claim 4, wherein the suction pump performs a sucking operation when the suction pump is rotated in a first direction, and the cap retaining member advances to the moving path of the cap holder in conjunction with the rotation of the suction pump in the first direction.

7. The inkjet recording device according to claim 6, wherein the suction pump is a tube pump which generates a negative pressure when a tube of the tube pump, arcuately disposed, is successively compressed with a roller.

8. The ink jet recording device according to claim 1, wherein at least one of the cap member and the wiping member is formed on the cap holder by two-color molding.

9. The inkjet recording device according to claim 1, wherein the cap member and the wiping member are made of the same soft material.

10. The ink jet recording device according to claim 9, further comprising a restriction mechanism for restricting a displacement of the cap holder apart from the nozzle forming surface when the nozzle forming surface is being wiped by the wiping member.

11. A method for driving and controlling an ink jet recording device including an ink jet recording head which is mounted on a carriage being reciprocatively movable from a print region to a home position, ejects ink drops in accordance with print data and includes a nozzle forming surface, a cap member disposed on a cap holder for sealing up the nozzle forming surface when the cap member comes in contact with the nozzle forming surface, and a wiping member disposed on the cap holder at a side of the print region for wiping the nozzle forming surface when the wiping member is brought into sliding contact with nozzle forming surface, the method comprising the steps of:

sucking and discharging ink from the recording head by applying a negative pressure from a suction pump into the cap member in a state that the nozzle forming surface is sealed with the cap member;

removing the sealing of the nozzle forming surface in conjunction with a movement of the carriage toward the print region, and stopping a downward movement of the cap holder by a cap retaining member having advanced to a moving path of the cap holder; and bringing the wiping member into sliding contact with the nozzle forming surface in conjunction with a further movement of the carriage to the print region.

12. An ink jet recording device having an ink jet recording head which is mounted on a reciprocatively movable carriage and ejects ink drops in accordance with print data and includes a nozzle forming surface, the ink jet recording device comprising:

a head cleaning mechanism located adjacent to a home position of the recording head for cleaning the recording head;

the head cleaning mechanism including:

a cap holder being located adjacent to the home position being movable to and from the nozzle forming surface;

a cap member supported on the cap holder and being brought into contact with the nozzle forming surface to seal up the nozzle forming surface;

a wiping member supported on the cap holder and being slidable on the nozzle forming surface to wipe the nozzle forming surface in conjunction with the movement of the cap holder, an interlocking mechanism for moving the cap holder to and from the nozzle forming surface in conjunction with the movements of the recording head to and from the home position, and causing the cap member to seal up the nozzle forming surface and removing the sealing of said nozzle forming surface;

a suction pump for applying a negative pressure to the cap member so that ink is sucked from the recording head and the sucked ink is discharged outside in a state that the nozzle forming surface is sealed with the cap member; and a holding mechanism selectively moved to and from a moving path of the cap holder for holding the cap holder at a position where the wiping member comes in sliding contact with the nozzle forming surface when the recording head is moved apart from the home position after the sucking and discharging of ink by the suction pump, so that the nozzle forming surface is wiped by the wiping member and so that the cap holder is moved away from the position where the wiping member comes in sliding contact with the nozzle forming surface after the wiping operation.

13. The ink jet recording device according to claim 12, wherein at least one of the cap member and the wiping member is integral with the cap holder.

14. The ink jet recording device according to claim 12, wherein the cap member and the wiping member are made of the same soft material.

15. The ink jet recording device according to claim 12, further comprising a restriction mechanism for restricting a displacement of the cap holder apart from the nozzle forming surface when the nozzle forming surface is being wiped by the wiping member.

16. The ink jet recording device according to claim 12, wherein the interlocking mechanism is provided corresponding to the home position of the carriage, and includes a driven member moved by the carriage and a converting unit for converting the movement of the driven member into the approaching and separating movements of the cap holder.

17. The ink jet recording device according to claim 16, wherein the holding mechanism is provided between the driven member and a device frame, and includes locking means for locking the driven member at the approaching position of the cap holder, and removing means for removing the locking state of said driven member with the movement of said carriage.

18. A method for driving and controlling an ink jet recording device according to claim 12, wherein when the recording head is moved to the home position, the cap member is brought into contact with the nozzle forming surface so that the nozzle forming surface is capped with the cap member, in this state, the operation of sucking ink is performed, thereafter, when the recording head is moved apart from the home position, the nozzle forming surface is brought into sliding contact with said wiping member so that a wiping operation is performed, and a flushing operation of idle ejecting ink drops from the recording head is performed in a state that the recording head is moved to a position just before the home position and the cap member is confronted with the nozzle forming surface without contact, thereafter, the recording head is moved apart from the position just before the home position, without sliding contact between the wiping member and the nozzle forming surface.

19. An ink jet recording device having an ink jet recording head which is mounted on a reciprocatively movable carriage and ejects ink drops in accordance with print data and includes a nozzle forming surface, the ink jet recording device comprising:

a head cleaning mechanism located adjacent to a home position of the recording head for cleaning the recording head;

the head cleaning mechanism including:

a cap holder being located adjacent to the home position being movable to and from the nozzle forming surface;

a cap member supported on the cap holder and being brought into contact with the nozzle forming surface to seal up the nozzle forming surface;

a wiping member supported on the cap holder and being slidable on the nozzle forming surface to wipe the nozzle forming surface in conjunction with the movement of the cap holder, an interlocking mechanism for moving the cap holder to and from the nozzle forming surface in conjunction with the movements of the recording head to and from the home position, and causing the cap member to seal up the nozzle forming surface and removing the sealing of said nozzle forming surface; and a holding mechanism selectively moved to and from a moving path of the cap holder for holding the cap holder at a position where the wiping member comes in sliding contact with the nozzle forming surface when the recording head is moved apart from the home position so that the nozzle forming surface is wiped by the wiping member and so that the cap holder is moved away from the position where the wiping member comes in sliding contact with the nozzle forming surface after the wiping operation.

* * * * *